US008417156B2

(12) United States Patent
Mera et al.

(10) Patent No.: US 8,417,156 B2
(45) Date of Patent: Apr. 9, 2013

(54) IMAGE FORMING METHOD, PROCESS CARTRIDGE AND IMAGE FORMING APPARATUS

(75) Inventors: Fumiaki Mera, Kanagawa (JP); Masaki Hirakata, Kanagawa (JP); Hirofumi Shiozaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 466 days.

(21) Appl. No.: 12/726,068

(22) Filed: Mar. 17, 2010

(65) Prior Publication Data

US 2011/0020030 A1 Jan. 27, 2011

(30) Foreign Application Priority Data

Jul. 27, 2009 (JP) ..... 2009-174572

(51) Int. Cl.
*G03G 15/08* (2006.01)
*G03G 15/20* (2006.01)

(52) U.S. Cl. ..... 399/252; 399/111; 399/339; 399/341

(58) Field of Classification Search ..... 399/252, 399/320, 111, 339, 341
See application file for complete search history.

(56) References Cited

U.S. PATENT DOCUMENTS 6,632,883 B2 10/2003 Mayes et al.
8,080,356 B2 * 12/2011 Teshima
2002/0064404 A1 * 5/2002 Iwai
2007/0092823 A1 4/2007 Matsumura et al.
2008/0153021 A1 * 6/2008 Ikuno et al. ..... 399/111
2010/0124715 A1 * 5/2010 Nakazawa et al. ..... 399/111
2010/0303489 A1 * 12/2010 Ishii

FOREIGN PATENT DOCUMENTS

AU 2006235981 A1 12/2007
JP A-2001-188426 7/2001
JP A-2003-029554 1/2003
JP A-2007-114635 5/2007
JP A-2007-310064 11/2007

* cited by examiner

*Primary Examiner* — Susan Lee
(74) *Attorney, Agent, or Firm* — Oliff & Berridge, PLC

(57) ABSTRACT

An image forming method includes charging an image holding member; forming an electrostatic latent image on a surface of the image holding member; developing the electrostatic latent image formed on the surface of the image holding member with a toner or an electrostatic image developer to form a toner image; transferring the toner image formed on the surface of the image holding member onto a surface of a transfer-receiving material; fixing the toner image by pressurization without heating; feeding at least one photoreactive component to the toner or toner image; and irradiating the toner image with ultraviolet rays, wherein the toner satisfies the relationship of the following relational expression (1):

$$T_B(30) \leqq 100 < T_A(30) \quad (1)$$

wherein $T_B$ (30) and $T_A$ (30) are defined in the specification.

18 Claims, 1 Drawing Sheet

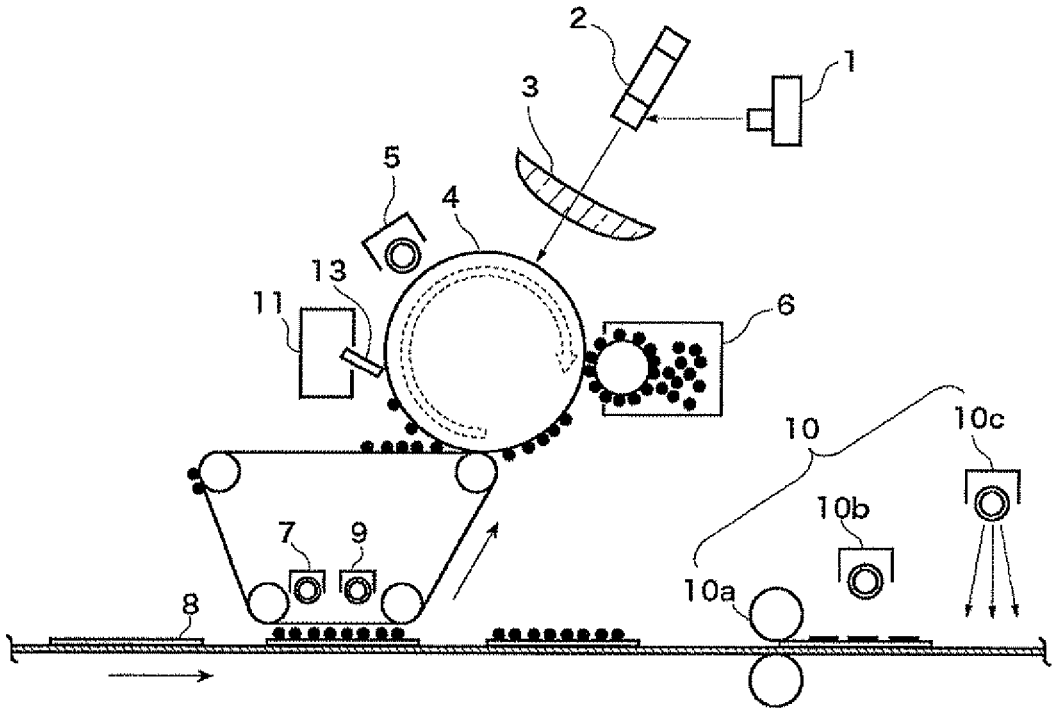
2
1
3
5
4
13
11
6
10
10c
10b
7
9
10a
8

IMAGE FORMING METHOD, PROCESS CARTRIDGE AND IMAGE FORMING APPARATUS

CROSS-REFERENCE TO RELATED APPLICATIONS

This application is based on and claims priority under 35 USC 119 from Japanese Patent Application No. 2009-174572 filed on Jul. 27, 2009.

BACKGROUND

1. Technical Field

The present invention relates to an image forming method, a process cartridge and an image forming apparatus.

2. Related Art

At present, a method of visualizing image information through an electrostatic image, such as electrophotography, is utilized in various fields. In the electrophotography, an electrostatic image (electrostatic latent image) is formed on a photoconductor (image forming member) by charge and exposure steps, and the electrostatic latent image is developed with a developer containing a toner and visualized through transfer and fixing steps. The developer which is used herein includes a two-component developer composed of a toner and a carrier and a single-component developer using a magnetic toner or a non-magnetic toner singly. As a method for manufacturing the toner, in general, a kneading pulverization manufacturing method in which a thermoplastic resin is melt kneaded together with a pigment, a charge controlling agent and a release agent such as waxes, and after cooling, the resulting mixture is finely pulverized and further classified is adopted. There may be the case where inorganic or organic particles for improving fluidity or cleaning properties are added onto the surface of the toner particle, if desired.

On the contrary, in an image forming method adopting the electrophotography, for the purpose of reducing the amount of energy consumption, technologies enabling one to perform fixing at a lower temperature are desired, and in particular, in recent years, in order to fully achieve energy conservation, it is desired to stop energization to a fixing device at the time of non-use. Accordingly, since the temperature of the fixing device is required to be raised to the use temperature in a moment at the time of energization, it is demanded to make the fixing temperature of the toner low.

As a measure for making the fixing temperature of a toner low, it is known to use a crystalline resin of a polycondensation type which reveals a sharp melt behavior against the temperature as a binder resin constituting the toner. However, a toner using a large amount of a crystalline resin is liable to cause yield deformation, and in the case where it is actually formulated into a toner, filming onto a conductor or a lowering with time of transfer efficiency due to toner collapse, etc. is easily caused.

As the foregoing related-art image forming method, since the acceleration of fixing by heating is a core rather than that by pressure, a reduction of energy at the time of fixing in an electrophotographic system does not significantly change the trend so that an improvement does not proceed, and in particular, there is no measure for realizing high-speed fixing by a simple fixing device, an aspect of which becomes important in correspondence to the printing market by the electrophotographic system. As a resin for toners capable of accelerating fixing by such heating, chain polymerization resins of a random monomer are widely used in all of addition polymerization and polycondensation.

On the contrary, in place of using thermal fixing, an image forming method using room-temperature pressure fixing by impressing a pressure of 20 MPa or more to a toner to subject the toner to plastic deformation and fixing it on paper is also used.

However, in this room-temperature pressure fixing system, since a high pressure of 20 MPa or more is used, the paper elongates, whereby the image becomes thick, or paper wrinkles are caused; and in the case where toner particles come into fibers of the paper, fixing failure in which fixing is not sufficiently achieved is easily caused. Therefore, an image forming apparatus using a pressure fixing system is not employed at the present, and a thermal fixing system is the main current.

SUMMARY

According to an aspect of the invention, there is provided an image forming method including: charging an image holding member; forming an electrostatic latent image on a surface of the image holding member; developing the electrostatic latent image formed on the surface of the image holding member with a toner or an electrostatic image developer to form a toner image; transferring the toner image formed on the surface of the image holding member onto a surface of a transfer-receiving material; fixing the toner image by pressurization without heating; feeding at least one photoreactive component to the toner or toner image; and irradiating the toner image with ultraviolet rays, wherein the toner satisfies the relationship of the following relational expression (1):

$$T_B(30) \leqq 100 < T_A(30) \quad (1)$$

wherein $T_B$ (30) represents a temperature (° C.) at which a viscosity of the toner reaches $10^4$ Pa·s at the time of impressing a load of 30 MPa by the flow tester method before the irradiating of the toner image; and $T_A$ (30) represents a temperature at which a viscosity of the toner reaches $10^4$ Pa·s at the time of impressing a load of 30 MPa by the flow tester method after the irradiating of the toner image.

BRIEF DESCRIPTION OF THE DRAWINGS

Exemplary embodiment(s) of the present invention will be described in detail based on the following figures, wherein:

FIG. 1 is a configuration conceptual view of an example of an image forming apparatus according to the present exemplary embodiment, wherein

1 denotes Semiconductor laser light source, 2 denotes Polygon mirror, 3 denotes fθ lens, 4 denotes Image holding member, 5 denotes Charge unit, 6 denotes Development unit, 7 denotes Transfer unit, 8 denotes Image support (transfer-receiving material), 9 denotes Separation unit (separation electrode), 10 denotes Fixing unit, 10*a* denotes Pressure roller, 10*b* denotes Unit of feeding photoreactive component, 10*c* denotes Irradiation unit, 11 denotes Cleaning unit and 13 denotes Cleaning blade.

DETAILED DESCRIPTION

The present exemplary embodiment is hereunder described.

The image forming method according to the present exemplary embodiment includes a charge step of charging an image holding member; a latent image forming step of forming an electrostatic latent image on the surface of the image holding member; a development step of developing the electrostatic latent image formed on the surface of the image holding member with a toner or an electrostatic image developer to form a toner image; a transfer step of transferring the toner image formed on the surface of the image holding member onto the surface of a transfer-receiving material; a fixing step of fixing the toner image by pressurization without heating; a feed step of feeding at least one photoreactive component to the toner or toner image; and an irradiation step of irradiating the toner image with ultraviolet rays, wherein the toner satisfies the relationship of the following relational expression (1).

$$T_B(30) \leqq 100 < T_A(30) \quad (1)$$

In the expression (1), $T_B$ (30) represents a temperature (° C.) at which a viscosity of the toner reaches $10^4$ Pa·s at the time of impressing a load of 30 MPa by the flow tester method before the irradiation step; and $T_A$ (30) represents a temperature at which a viscosity of the toner reaches $10^4$ Pa·s at the time of impressing a load of 30 MPa by the flow tester method after the irradiation step of the toner.

<Image Forming Method>

The outline of the image forming method according to the present exemplary embodiment is hereunder described with reference to FIG. 1.

After a charge step of charging an image holding member 4 uniformly and homogeneously without causing unevenness by a charge unit 5, a latent image forming step is carried out by emitting exposure light from a semiconductor laser light source 1 on the basis of information read by an original reader, distributing the emitted light to the vertical direction against the paper surface by a polygon mirror 2 and irradiating the distributed light on the image holding member 4 via an fθ lens 3 capable of correcting a strain of an image.

After a development step of developing an electrostatic latent image on the image holding member 4 by a development unit 6, a formed toner image is transferred onto a transfer-receiving material (image support) 8 having been conveyed while fixing the timing by the action of a transfer unit 7. Furthermore, though the image holding member 4 and the transfer-receiving material 8 are separated from each other by a separation unit (separation electrode) 9, the toner image is transferred to and held by the image support 8 and then introduced into a fixing unit 10, thereby carrying out a fixing step.

In the fixing step, the toner image is temporarily fixed onto the transfer-receiving material 8 by a fixing step of performing pressure fixing by a pair of pressure rollers 10*a* without heating. Furthermore, a feed step of feeding a photoreactive component to the toner image in a sprayed form or by a coating roller or the like from a unit 10*b* of feeding the photoreactive component; and an irradiation step of irradiating the toner image with ultraviolet rays from an irradiation unit 10*c* are carried out, thereby obtaining a fixed image.

A cleaning step of cleaning up an untransferred toner which remains on the surface image holding member 4 or the like by a cleaning unit 11 of a cleaning blade mode may be carried out, or a step of removing a residual charge by exposure before charge (not illustrated) may be added. Furthermore, for the subsequent image formation, a charge step of performing homogeneous charge is again repeated by the charge unit 5.

In the image forming method according to the present exemplary embodiment, all of the foregoing charge step, latent image forming step, development step and transfer step are a general step in itself and are disclosed in, for example, JP-A-56-40868, JP-A-49-91231, etc.

The foregoing various steps of the image forming method are carried out using an image forming apparatus which is known in itself, for example, copiers, facsimile machines, etc.

The various steps of the image forming method are hereunder described in detail.

As the charge step of charging the image holding member, a conventionally known step is adoptive.

Also, the foregoing latent image forming step is a step of forming an electrostatic latent image on the surface of the image holding member.

The foregoing development step is a step of developing the electrostatic latent image by a developer layer on a developer carrier to form a toner image. As the developer layer, a so-called baroplastic toner as described later or an electrostatic image developer containing this toner and a carrier is useful.

The foregoing transfer step is a step of transferring the toner image onto a transfer-receiving material.

The foregoing fixing step is a step of pressure fixing the toner image having been transferred onto a transfer-receiving material such as recording paper by a pressure fixing device or the like, thereby forming a reproduced image.

In the present exemplary embodiment, the fixing step is carried out by pressurization.

This fixing step is a pressure fixing step of fixing a toner image by pressurization without heating. A fixing temperature is preferably not higher than an operation temperature of the image forming apparatus, more preferably not higher than 50° C., and especially preferably from 10° C. to 40° C. When the fixing temperature falls within the foregoing range, favorable fixability is obtainable.

A fixing pressure is preferably from about 1 MPa to about 5 MPa.

When the pressure (fixing pressure) at the time of fixing is 1 MPa or more, sufficient fixability is obtainable. Also, when the pressure at the time of fixing is not more than 5 MPa, the generation of image staining or fixing roller contamination or paper winding is low due to the generation of offset or the like; and also, a problem that the paper after fixing bends (paper curl) is hardly caused.

Also, a cleaning step may be included after the fixing step, if desired.

The fixing pressure as referred to herein means the following maximum fixing pressure.

As the fixing roller, a conventionally known fixing roller may be properly chosen and used within the range where the foregoing fixing pressure can be impressed.

Examples thereof include fixing rollers in which a fluorocarbon resin (for example, TEFLON (a registered trademark)), a silicon based resin, a copolymer of tetrafluoroethylene ($C_2F_4$) and a perfluoroalkoxyethylene (PFA), etc. is coated on a cylindrical mandrel. Also, in order to obtain a high fixing pressure, a fixing roller made of stainless steel (SUS) may be used. In general, the fixing step is carried out by allowing the transfer-receiving material to pass between the two rollers. The two rollers may be formed of the same material or a different material from each other. Examples thereof include combinations such as SUS/SUS, SUS/silicon resin, SUS/PFA and PFA/PFA.

Pressure distribution between a fixing roller and a pressure roller or the like may be measured by a commercially available pressure distribution measuring sensor. Specifically, the pressure distribution may be measured by a roller-roller pressure measuring system, manufactured by Kamata Industry Co., Ltd. or the like. In the present exemplary embodiment, a maximum fixing pressure at the time of pressure fixing represents a maximum value in a pressure change of a fixing nip from the inlet to the outlet in the paper traveling direction.

The foregoing cleaning step is a step of removing the toner remaining on the image holding member. In the image forming method according to the present exemplary embodiment, an embodiment further including a recycle step is preferable.

The recycle step is a step of transferring the electrostatic-image-developing toner recovered in the cleaning step to the developer layer. The image forming method of an embodiment including this recycle step may be carried out using an image forming apparatus such as a copier or a facsimile machine of a toner recycle system type. Also, a recycle system of an embodiment in which the cleaning step is omitted, and the toner is recovered simultaneously with the development may be applied.

A desired reproduced article (for example, a printed matter, etc.) is obtained through a series of these treatment steps.

In the present exemplary embodiment, it is preferable that the toner satisfies the relationship of the following relational expression (1).

$$T_B(30) \leqq 100 < T_A(30) \quad (1)$$

In the expression (1), $T_B$ (30) represents a temperature (° C.) at which a viscosity of the toner reaches $10^4$ Pa·s at the time of impressing a load of 30 MPa by the flow tester method before the irradiation step; and $T_A$ (30) represents a temperature at which a viscosity of the toner reaches $10^4$ Pa·s at the time of impressing a load of 30 MPa by the flow tester method after the irradiation step of the toner.

The foregoing feed step is a step of feeding at least one photoreactive component to the toner or toner image. As the photoreactive component, known components can be utilized.

As the photoreactive component, components capable of undergoing a curing reaction upon being irradiated with active radiations are preferable, and specific examples thereof include a component capable of undergoing photodimerization and a component capable of undergoing photopolymerization. As the component capable of undergoing photodimerization, a cinnamic acid ester can be exemplified. The component capable of undergoing photopolymerization is an addition polymerizable component which is used through a combination with a photopolymerization initiator and which is capable of being polymerized with a polymerization initiation species emitted from the photopolymerization initiator. Examples of the photopolymerization initiator include a compound which absorbs active radiations to emit a radical polymerization initiation species or a cationic polymerization initiation species. The addition polymerizable component is not limited with respect to a reaction mechanism thereof, and examples thereof include a radical polymerizable ethylenically unsaturated compound, a cationic polymerizable epoxy compound and an oxetanyl compound. In the present exemplary embodiment, the addition polymerizable component is preferably a radical polymerizable ethylenically unsaturated compound.

Examples of the ethylenically unsaturated compound include compounds having a (meth)acryloyloxy group, a (meth)acrylamide group or a vinyl group (the term "(meth) acryloyl" or the like is synonymous with "methacryloyl" and/or "acryloyl"; hereinafter the same).

As the photoreactive component, a combination of an addition polymerizable unsaturated compound and a photopolymerization initiator is preferable, and a combination of an ethylenically unsaturated compound and a photo radical polymerization initiator is more preferable. The ethylenically unsaturated compound is a monofunctional or preferably a bifunctional or polyfunctional low-molecular or oligomer compound. Here, the term "low-molecular" means that the molecular weight is not more than 500; the term "oligomer" means that the molecular weight is more than 500 and is not more than 2,000; and the term "polymer" means that the molecular weight is more than 2,000 and is not more than 1,000,000.

A combination of a cationic polymerizable compound such as an epoxy compound and an oxetane compound and a photo cationic polymerization initiator (photo-acid generator) is also useful.

In one present exemplary embodiment, it is preferable that a photo radical polymerization initiator is fed to a toner particle composed of a polymer having an ethylenically unsaturated group as a binder resin in the steps after fixing.

In another exemplary embodiment, it is also preferable that a photopolymerization initiator is further incorporated into a toner particle composed of a polymer having an ethylenically unsaturated group as a binder resin and that a photoreactive component is not fed at all in the steps after fixing.

A feed step of feeding at least one photoreactive component to the toner or toner image may be carried out before completion of a toner particle, thereby forming a toner particle having at least one photoreactive component or all photoreactive components incorporated thereinto; or the feed step may be carried out after completion of a toner particle, thereby feeding, as an external additive, at least one photoreactive component or all photoreactive components into the toner particle or toner image.

Also, a feed step of feeding a photoreactive component or components may be spanned before and after completion of a toner particle. For example, the binder resin having an ethylenically unsaturated group is used before completion of a toner particle, or the ethylenically unsaturated compound is incorporated into a toner particle, thereby feeding a photopolymerization initiator-containing solution to the transferred toner image.

(Ethylenically Unsaturated Compound)

The radical polymerizable compound which can be used in the present exemplary embodiment is a compound having a radical polymerizable ethylenically unsaturated group, and any compound may be useful so far as it is a compound having at least one radical polymerizable ethylenically unsaturated group in a molecule thereof. The radical polymerizable compound includes a monomer, an oligomer and a polymer, and of these, a monomer and an oligomer are preferable.

As the ethylenically unsaturated compound, only one kind thereof may be used, and two or more kinds thereof may be used in combinations in an arbitrary ratio for the purpose of enhancing desired characteristics. In view of controlling performances such as reactivity and physical properties, it is preferable to use two or more kinds of ethylenically unsaturated compounds in combinations.

Examples of the radical polymerizable ethylenically unsaturated compound include radical polymerizable compounds such as unsaturated carboxylic acids, for example, acrylic acid, methacrylic acid, itaconic acid, crotonic acid, isocrotonic acid, maleic acid, etc., and salts thereof; acid anhydrides having an ethylenically unsaturated group; acrylonitrile; styrene; and various unsaturated polyesters, unsaturated polyethers, unsaturated polyamides and unsaturated urethanes.

In the present exemplary embodiment, in the case where the binder resin of a toner is composed of at least a high-Tg component and a low-Tg component, it is also preferable that the high-Tg component is a reactive polymer having an ethylenically unsaturated group in a side chain or molecular end thereof, which is obtained by copolymerizing a polyfunctional monomer such as 1,4-divinylbenzene with a monofunctional monomer such as alkyl acrylates and styrene. Also, in the present exemplary embodiment, a reactive polyester in which an alcohol having an ethylenically unsaturated group is ester-bonded to a main chain of the polyester is preferably used as the high-Tg component.

Specific examples of the ethylenically unsaturated compound include acrylic acid derivatives such as methyl acrylate, ethyl acrylate, n-butyl acrylate, 2-ethylhexyl acrylate, 2-hydroxyethyl acrylate, butoxyethyl acrylate, carbitol acrylate, cyclohexyl acrylate, tetrahydrofurfuryl acrylate, benzyl acrylate, bis(4-acryloxypolyethoxyphenyl)propane, neopentyl glycol diacrylate, 1,6-hexanediol diacrylate, ethylene glycol diacrylate, diethylene glycol diacrylate, triethylene glycol diacrylate, tetraethylene glycol diacrylate, polyethylene glycol diacrylate, propylene glycol diacrylate, dipropylene glycol diacrylate, tripropylene glycol diacrylate, tetrapropylene glycol diacrylate, polypropylene glycol diacrylate, pentaerythritol triacrylate, pentaerythritol tetraacrylate, dipentaerythritol tetraacrylate, trimethylolpropane triacrylate, tetramethylolmethane tetraacrylate, oligoester acrylate, N-methylol acrylamide, diacetone acrylamide, epoxy acrylate, lauryl acrylate and hexanediol diacrylate; methacrylic acid derivatives such as methyl methacrylate, ethyl methacrylate, n-butyl methacrylate, 2-ethylhexyl methacrylate, lauryl methacrylate, allyl methacrylate, glycidyl methacrylate, benzyl methacrylate, dimethylaminomethyl methacrylate, 1,6-hexanediol dimethacrylate, ethylene glycol dimethacrylate, triethylene glycol dimethacrylate, polyethylene glycol dimethacrylate, polypropylene glycol dimethacrylate, trimethylolethane trimethacrylate, trimethylolpropane trimethacrylate and 2,2-bis(4-methacryloxypolyethoxyphenyl) propane; N-vinyl compounds such as N-vinylpyrrolidone and N-vinylcaprolactam; and derivatives of an allyl compound such as allyl glycidyl ether, diallyl phthalate and triallyl trimellitate. More specifically, radical polymerizable or crosslinkable monomers, oligomers and polymers which are commercially available or known in the industry and which are described in *Crosslinking Agent Handbook*, edited by Shinzo YAMASHITA and published by Taiseisha Ltd. (1981); *UV.EB Curing Handbook* (*Raw Material Volume*), edited by Kiyoshi KATO and published by Kobunshi Kankokai (1985); *Applications and Markets of UV.EB Curing Technologies*, page 79 (1989), edited by RadTech Japan and published by CMC Publishing Co., Ltd.; *Polyester Resin Handbook*, written by Eiichiro TAKIYAMA and published by The Nikkan Kogyo Shimbun, Ltd. (1988); and so on are useful.

Of these, tripropylene glycol diacrylate, N-vinylcaprolactam, lauryl acrylate and hexanediol diacrylate are preferably useful.

Also, as the radical polymerizable compound, polymerizable compound materials of a photocuring type which are used for a photopolymerizable composition disclosed in, for example, JP-A-7-159983, JP-B-7-31399, JP-A-8-224982, JP-A-10-863, JP-A-9-134011, etc. are known, and these materials are applicable in the present exemplary embodiment.

Examples of other polymerizable compounds which can be used in the present exemplary embodiment include (meth) acrylic acid esters such as (meth)acrylic monomers or prepolymers, epoxy based monomers or prepolymers and urethane based monomers or prepolymers (such a (meth)acrylic acid ester will be also hereinafter properly referred to as "acrylate compound"). Compounds having an alicyclic hydrocarbon group are also preferably useful.

That is, examples of such a (meth)acrylic acid ester include acrylate compounds such as 2-ethylhexyl diglycol acrylate, 2-hydroxy-3-phenoxypropyl acrylate, 2-hydroxybutyl acrylate, hydroxypivalic acid neopentyl glycol diacrylate, 2-acryloyloxyethyl phthalate, methoxypolyethylene glycol acrylate, tetramethylolmethane triacrylate, 2-acryloyloxyethyl-2-hydroxyethyl phthalate, dimethyloltricyclodecane diacrylate, ethoxylated phenyl acrylate, 2-acryloyloxyethyl succinate, nonylphenol ethylene oxide (EO) adduct acrylate, modified glycerin triacrylate, bisphenol A diglycidyl ether acrylic acid adduct, modified bisphenol A diacrylate, phenoxypolyethylene glycol acrylate, 2-acryloyloxyethyl hexahydrophthalate, propylene oxide (PO) adduct diacrylate of bisphenol A, EO adduct diacrylate of bisphenol A, dipentaerythritol hexaacrylate, pentaerythritol triacrylate tolylene diisocyanate urethane prepolymer, lactone-modified flexible acrylate, butoxyethyl acrylate, propylene glycol diglycidyl ether acrylic acid adduct, pentaerythritol triacrylate hexamethylene diisocyanate urethane prepolymer, 2-hydroxyethyl acrylate, methoxydipropylene glycol acrylate, ditrimethylolpropane tetraacrylate, pentaerythritol triacrylate, hexamethylene diisocyanate urethane prepolymer, stearyl acrylate, isoamyl acrylate, isomyristyl acrylate, isostearyl acrylate and lactone-modified acrylate; and methacrylate compounds obtained by changing the acryloyloxy group of such an acrylate compound to a methacryloxy group.

(Photopolymerization Initiator)

In one present exemplary embodiment, a photopolymerization initiator is fed as the photoreactive component to the toner or toner image.

As the photopolymerization initiator, known photopolymerization initiators can be used. In the present exemplary embodiment, in the case where the ethylenically unsaturated compound is used as the photoreactive component, it is preferable to feed a radical photopolymerization initiator.

The photopolymerization initiator which can be fed to the toner or toner image is a compound which absorbs external energy due to active radiations to emit a polymerization initiation species. Examples of the active radiations include γ-rays, β-rays, electron beams, ultraviolet rays, visible light beams and infrared rays. The wavelength to be used is not particularly limited. A wavelength region of from 200 nm to 500 nm is preferable, and a wavelength region of from 200 nm to 450 nm is more preferable.

Examples of the radical photopolymerization initiator which can be preferably used in the present exemplary embodiment include (a) an aromatic ketone, (b) an acyl phosphine compound, (c) an aromatic onium salt compound, (d) an organic peroxide, (e) a thio compound, (f) a hexaaryl biimidazole compound, (g) a keto oxime ester compound, (h) a borate compound, (i) an azinium compound, (j) a metallocene compound, (k) an active ester compound, (l) a compound having a carbon-halogen bond and (m) an alkylamine compound.

From the viewpoint of transparency, when the photopolymerization initiator is deposited in a thickness of 3 g/cm$^2$, a compound having an absorbance of not more than 0.3 at a wavelength of 400 nm is preferable, a compound having an absorbance of not more than 0.2 at a wavelength of 400 nm is more preferable, and a compound having an absorbance of not more than 0.1 at a wavelength of 400 nm is further preferable as the photopolymerization initiator.

Of these, the photopolymerization initiator is preferably (a) an aromatic ketone, (b) an acyl phosphine compound or (c) an aromatic onium salt compound.

The photopolymerization initiator in the present exemplary embodiment may be used singly or in combinations of two or more kinds thereof.

A content or feed amount of the photopolymerization initiator in the present exemplary embodiment is preferably from about 0.01% by weight to about 35% by weight, more preferably from about 0.1% by weight to about 30% by weight, and further preferably from about 0.5% by weight to 3 about 0% by weight relative to the total amount of the foregoing ethylenically unsaturated component.

Also, in the case where a sensitizer as described later is used, the photopolymerization initiator is used relative to the sensitizer in an amount of preferably from 200/1 to 1/200, more preferably from 50/1 to 1/50, and further preferably from 20/1 to 1/5 in terms of a weight ratio of the photopolymerization initiator to the sensitizer.

In the present exemplary embodiment, in the case where a cationic polymerizable component is used, for example, a compound which is utilized for chemical amplification type photoresists or photo cationic polymerization is used as the cationic polymerization initiator (photo-acid generator).

The photopolymerization initiator may be used singly or in combinations of two or more kinds thereof.

(Photosensitizer)

In the present exemplary embodiment, in order to accelerate decomposition of the photopolymerization initiator upon being irradiated with active radiations, a sensitizer is used in combinations.

The sensitizer absorbs specified active radiations to become in an electron-excited state. The sensitizer having become in an electron-excited state comes into contact with the polymerization initiator to cause an action such as electron transfer, energy transfer and heat generation, thereby accelerating a chemical change of the photopolymerization initiator, namely decomposition and generation of a radical, an acid or a base.

<Image Forming Apparatus>

The image forming apparatus according to the present exemplary embodiment includes an image holding member; a charge unit of charging the image holding member; an exposure unit of exposing the charged image holding member to form an electrostatic latent image on the surface of the image holding member; a development unit of developing the electrostatic latent image with a developer containing a toner to form a toner image; a transfer unit of transferring the toner image onto the surface of a transfer-receiving material from the image holding member; a fixing unit of pressurizing the transferred toner image on the surface of the transfer-receiving material; a feed unit of feeding at least one photoreactive component to the toner or toner image; and an irradiation unit of irradiating the fixed toner image with ultraviolet rays, wherein the toner satisfies the relationship of the following relational expression (1).

$$T_B(30) \leqq 100 < T_A(30) \quad (1)$$

In the expression (1), $T_B$ (30) represents a temperature (° C.) at which a viscosity of the toner reaches $10^4$ Pa·s at the time of impressing a load of 30 MPa by the flow tester method before the irradiation step; and $T_A$ (30) represents a temperature at which a viscosity of the toner reaches $10^4$ Pa·s at the time of impressing a load of 30 MPa by the flow tester method after the irradiation step of the toner.

It is preferable that the foregoing image holding member and the foregoing respective units have the configurations described in the respective steps of the foregoing image forming method.

Units which are known in image forming apparatuses may be used for all of the foregoing respective units. Also, the image forming apparatus which is used in the present exemplary embodiment may include units, apparatuses, etc. other than the foregoing configurations.

In the image forming apparatus according to the present exemplary embodiment, a fixing pressure of the fixing unit is preferably from about 1 MPa to about 5 MPa.

In the image forming apparatus according to the present exemplary embodiment, the irradiation unit is preferably a UV-LED ultraviolet light source.

The configuration of this image forming apparatus is described later in detail with reference to FIG. 1.

(Binder Resin)

The electrostatic-image-developing toner which is used in the present exemplary embodiment contains a binder resin.

The binder resin which is used in the present exemplary embodiment is preferably a resin revealing pressure fluidity, namely a baroplastic. The binder resin is preferably a resin which is constituted of a combination of at least a resin having a high glass transition temperature (hereinafter also referred to as "high-Tg component" or "high-Tg resin") and a resin having a low glass transition temperature (hereinafter also referred to as "low-Tg component" or "low-Tg resin").

In the case where the high-Tg component and the low-Tg component form a micro phase separation state, the resulting resin reveals a plastic behavior against pressure and reveals fluidity under a pressure of a certain level or more even in an ordinary temperature region. Such a resin is called a baroplastic.

In the present exemplary embodiment, a baroplastic having a photoreactive group, for example, an ethylenically unsaturated group, chemically bonded thereto can also be preferably used. In that case, it is preferable that an ethylenically unsaturated group is bonded to the high-Tg component. Furthermore, the photopolymerization initiator may coexist with the baroplastic.

As the photoreactive group, a group capable of undergoing a curing reaction upon being irradiated with active radiations is preferable, and specific examples thereof include a group capable of undergoing photodimerization and a group capable of undergoing photopolymerization. As the group capable of undergoing photodimerization, a cinnamic acid ester residue can be exemplified. The group capable of undergoing photopolymerization is an addition polymerizable reactive group which is used through a combination with a photopolymerization initiator and which is capable of being polymerized with a polymerization initiation species emitted from the photopolymerization initiator. Examples of the photopolymerization initiator include a compound which absorbs active radiations to emit a radical polymerization initiation species or a cationic polymerization initiation species. The addition polymerizable reactive group is not limited with respect to a reaction mechanism thereof, and examples thereof include groups having a radical polymerizable ethylenically unsaturated group, a cationic polymerizable epoxy group or an oxetanyl group. In the present exemplary embodiment, the photoreactive group is preferably a group having a radical polymerizable ethylenically unsaturated group.

Examples of the group having an ethylenically unsaturated group include a (meth)acryloyloxy group, a (meth)acrylamide group and a vinyl group (the term "(meth)acryloyl" or the like is synonymous with "methacryloyl" and/or "acryloyl"; hereinafter the same).

As the resin which is constituted of a combination of at least a high-Tg resin and a log-Tg resin, (A) a block copolymer which has two kinds of blocks and in which a difference in a glass transition temperature between the foregoing two kinds of blocks is 20° C. or more; (B) a resin composed of aggregated resin particles having a core-shell structure in which a difference between a glass transition temperature of a resin constituting a core and a glass transition temperature of a resin constituting a shell is 20° C. or more; and/or (C) a resin mixture in which a sea-island structure is formed of two kinds of resins having a difference in a glass transition temperature of 20° C. or more from each other is preferable. Of these, (A) a block copolymer which has two kinds of blocks and in which a difference in a glass transition temperature between the foregoing two kinds of blocks is 20° C. or more; and/or (B) a resin obtained by at least aggregating at least core-shell resin particles in which a difference between a glass transition temperature of a resin constituting a core and a glass transition temperature of a resin constituting a shell is 20° C. or more is more preferable.

The Tg of a high-Tg phase composed of the high-Tg resin is preferably in the range of from 45° C. to 120° C., and more preferably from 50° C. to 110° C. What the Tg of the high-Tg phase is 45° C. or higher is preferable because storage properties of the toner are excellent, caking at the time of conveyance or in a machine such as a printer or filming onto a photoconductor at the time of continuous printing or the like is hardly generated, and an image quality defect is hardly caused. Also, what the Tg of the high-Tg phase is not higher than 120° C. is preferable because the fixing temperature at the time of fixing (in particular, at the time of fixing on thick paper) is adequate, and damages to the transfer-receiving material, such as curl, are hardly caused.

Also, it is important that the Tg of the low-Tg phase composed of the low-Tg resin is lower than the Tg of the high-Tg phase by 20° C. or more. It is preferable that the Tg of the low-Tg phase composed of the low-Tg resin is lower than the Tg of the high-Tg phase by 30° C. or more. When a difference in Tg between the high-Tg phase and the low-Tg phase is within 20° C., a pressure plasticization behavior is hard to be sufficiently observed, the fixing temperature at the time of fixing (in particular, at the time of fixing on thick paper) is high, and it causes damages to the transfer-receiving material, such as curl.

Also, in the resin composed of aggregated resin particles having a core-shell structure, it is preferable to prepare the core by a low-Tg resin and the shell layer by a high-Tg resin, respectively. When the core is constituted of a low-Tg resin, and the shell is constituted of a high-Tg resin, the respective particles are constituted such that the low-Tg layer is not exposed on the resin particle. Therefore, in the case where the toner particle is prepared using the foregoing materials, since the low-Tg component is not exposed on the surface, powder fluidity and storage properties of the particle are secured.

[(A) Block Copolymer which as Two Kinds of Blocks and in which a Difference in a Glass Transition Temperature Between the Foregoing Two Kinds of Blocks is 20° C. or More]

As the binder resin, (A) a block copolymer which has two kinds of blocks and in which a difference in a glass transition temperature between the foregoing two kinds of blocks is 20° C. or more, is preferable.

For forming each of the blocks of the block copolymer, any of an addition polymerization based resin or a polycondensation based resin may be used. Examples of the former include homopolymers or copolymers of an ethylenically unsaturated compound; and examples of the latter include polyester based homopolymers or copolymers.

Examples of the polyester based block copolymer include polyester based block copolymers such as a crystalline polyester block and a non-crystalline polyester block.

The block copolymer is preferably a block copolymer having a block having a glass transition temperature of 60° C. or higher and a block having a glass transition temperature of not higher than 20° C.

Examples of the ethylenically unsaturated compound which is preferably used for the preparation of a block having a glass transition temperature of 60° C. or higher include styrenes such as styrene, para-chlorostyrene and α-methylstyrene. Of these, styrene is preferably useful.

Also, as the ethylenically unsaturated compound which is preferably used for the polymerization of a block having a glass transition temperature of not higher than 20° C., (meth) acrylic acid esters are preferable; acrylic acid esters are more preferable; alkyl acrylates in which an alkyl moiety thereof has from 1 carbon atom to 8 carbon atoms are further preferable; and methyl acrylate, butyl acrylate, hexyl acrylate, 2-ethylhexyl acrylate and so on are especially preferable.

In preparing such a block copolymer of an ethylenically unsaturated compound, various living polymerization methods, for example, anionic polymerization, cationic polymerization, radical polymerization and coordination polymerization, may be adopted. Above all, it is preferable to adopt living radical polymerization in view of easiness of combination of monomers thereof.

A number average molecular weight Mn of the block copolymer is preferably from 10,000 to 150,000, more preferably from 20,000 to 100,000, and further preferably from 30,000 to 60,000. What the number average molecular weight Mn of the block copolymer falls within the foregoing range is preferable because a sufficient pressure plasticity flow behavior is obtainable.

The polyester based block copolymer is described.

The polyester based block copolymer is manufactured by a polymer reaction or a polycondensation reaction. More specifically, for example, a method of binding a mixture of a crystalline polyester resin and a non-crystalline polyester resin by means of a polymer reaction; a method of mixing a previously manufactured crystalline polyester resin with a non-crystalline polyester resin forming monomer and polymerizing the mixture or an inverse method thereof; and so on are adopted.

In the polyester based block copolymer, a glass transition temperature of the high-Tg block is preferably 60° C. or higher, and more preferably from 70° C. to 110° C.

Also, it is preferable that the high-Tg block and the low-Tg block account for 60% by weight or more of the block copolymer; it is more preferable that the high-Tg block and the low-Tg block account for from 80% by weight to 100% by weight of the block copolymer; and it is further preferable that the block copolymer is a diblock copolymer composed of the high-Tg block and the low-Tg block.

Also, as a ratio of the high-Tg block and the low-Tg block, when the total sum of the high-Tg block and the low-Tg block is defined as 100% by weight, it is preferable that a proportion for which the high-Tg block accounts is from 25% by weight to 75% by weight.

Furthermore, a difference between the glass transition temperature of the high-Tg resin capable of forming a high-Tg block and the glass transition temperature of the low-Tg resin capable of forming a low-Tg block is 20° C. or more, preferably 30° C. or more, more preferably 40° C. or more, and further preferably 60° C. or more.

Specific examples of each of the blocks capable of forming the polyester based block copolymer include a crystalline polyester block and a non-crystalline polyester block.

Such a crystalline polyester resin or non-crystalline polyester resin capable of forming such a block is, for example, manufactured by using an aliphatic, alicyclic or aromatic polyvalent carboxylic acid or an alkyl ester thereof and a polycondensable monomer such as polyhydric alcohols or ester compounds thereof and hydroxycarboxylic acids and polycondensing them in an aqueous medium by means of a direct esterification reaction, an ester exchange reaction, etc.

It is meant by the term "crystalline" as shown in the foregoing "crystalline polyester resin" that the polyester resin has a distinct endothermic peak but not a stepwise endothermic change in the differential scanning calorimetry (DSC). Specifically, it is meant that a half value width of the endothermic peak in the measurement at a temperature rising rate of 10° C./min falls within 15° C.

On the contrary, it is meant that a resin in which a half value width of the endothermic peak exceeds 15° C., or a resin in which a distinct endothermic peak is not seen is non-crystalline (amorphous).

The polyvalent carboxylic acid which is used as the polycondensable monomer is a compound containing two or more carboxyl groups in one molecule thereof. Of these, a dicarboxylic acid is a compound containing two carboxyl groups in one molecule thereof. Examples thereof include oxalic acid, glutaric acid, succinic acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-dicarboxylic acid, hexahydroterephthalic acid, malonic acid, pimelic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid and cyclohexanedicarboxylic acid.

Also, examples of the polyvalent carboxylic acid other than the dicarboxylic acid include trimellitic acid, pyromellitic acid, naphthalenetricarboxylic acid, naphthalenetetracarboxylic acid, pyrenetricarboxylic acid and pyrenetetracarboxylic acid.

Also, those obtained by inducing the carboxyl group of such a carboxylic acid into an acid anhydride, a mixed acid anhydride, an acid chloride, an ester or the like may be used.

Also, the polyol which is used as the polycondensable monomer is a compound containing two or more hydroxyl groups in one molecule thereof. Of these, a diol is a compound containing two hydroxyl groups in one molecule thereof. Examples thereof include ethylene glycol, propylene glycol, butanediol, diethylene glycol, hexanediol, cyclohexanediol, octanediol, decanediol and dodecanediol.

Also, examples of the polyol other than the diol include glycerin, pentaerythritol, hexamethylolmelamine, hexaethylolmelamine, tetramethylolbenzoguanamine and tetraethylolbenzoguanamine.

Since such a polyol is sparingly soluble or insoluble in an aqueous medium, an ester synthesis reaction proceeds in a monomer droplet having a polyol dispersed in an aqueous medium.

Also, a hydroxycarboxylic acid is used as a polycondensable monomer.

The hydroxycarboxylic acid as referred to herein is a compound having both a hydroxyl group and a carboxyl group in a molecule thereof. Examples of the hydroxycarboxylic acid include an aromatic hydroxycarboxylic acid and an aliphatic hydroxycarboxylic acid. Of these, it is preferable to use an aliphatic hydroxycarboxylic acid.

Also, examples of the hydroxycarboxylic acid which is used as the polycondensable monomer include hydroxyheptanoic acid, hydroxyoctanoic acid, hydroxydecanoic acid, hydroxyundecanoic acid, tartaric acid, mucic acid, malic acid, citric acid and lactic acid.

The non-crystalline polyester resin or crystalline polyester resin is easily obtainable through a combination of such polycondensable monomers.

Of the foregoing carboxylic acids, examples of the polyvalent carboxylic acid which is used for obtaining a crystalline polyester resin include oxalic acid, malonic acid, succinic acid, glutaric acid, adipic acid, pimelic acid, suberic acid, azelaic acid, sebacic acid, maleic acid, fumaric acid, citraconic acid, itaconic acid, glutaconic acid, n-dodecylsuccinic acid, n-dodecenylsuccinic acid, isododecylsuccinic acid, isododecenylsuccinic acid, n-octylsuccinic acid, n-octenylsuccinic acid and an acid anhydride or acid chloride thereof.

Examples of the polyol which is used for obtaining a crystalline polyester resin include ethylene glycol, diethylene glycol, triethylene glycol, 1,2-propylene glycol, 1,3-propylene glycol, 1,4-butanediol, 1,4-butenediol, neopentyl glycol, 1,5-pentanediol, 1,6-hexanediol, 1,4-cyclohexanediol, 1,4-cyclohexanedimethanol, dipropylene glycol, polyethylene glycol and polypropylene glycol.

Also, the crystalline polyester resin which is obtained by ring-opening polymerization of a cyclic monomer such as caprolactone is preferable because its crystal melting temperature lies in the vicinity of 60° C. which falls with a suitable region as a toner.

Examples of such a crystalline polyester resin include a polyester resin obtained by allowing 1,9-nonanediol and 1,10-decanedicarboxylic acid to react with each other; a polyester resin obtained by allowing cyclohexanediol and adipic acid to react with each other; a polyester resin obtained by allowing 1,6-hexanediol and sebacic acid to react with each other; a polyester resin obtained by allowing ethylene glycol and succinic acid to react with each other; a polyester resin obtained by allowing ethylene glycol and sebacic acid to react with each other; and a polyester resin obtained by allowing 1,4-butanediol and succinic acid to react with each other. Of these, a polyester resin obtained by allowing 1,9-nonanediol and 1,10-decanedicarboxylic acid to react with each other and a polyester resin obtained by allowing 1,6-hexanediol and sebacic acid to react with each other are especially preferable.

Also, of the foregoing polyvalent carboxylic acids, examples of the polyvalent carboxylic acid which is used for the purpose of obtaining the non-crystalline polyester resin include dicarboxylic acids such as phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid and cyclohexanedicarboxylic acid. Also, examples of the polyvalent carboxylic acid other than the dicarboxylic acid include trimellitic acid, pyromellitic acid, naphthalenetricarboxylic acid, naphthalenetetracarboxylic acid, pyrenetricarboxylic acid and pyrenetetracarboxylic acid. Also, those obtained by inducing the carboxyl group of such a carboxylic acid into an acid anhydride, an acid chloride, an ester or the like may be used.

Of these, it is preferable to use terephthalic acid or a lower ester thereof, diphenylacetic acid, cyclohexanedicarboxylic acid or the like. The lower ester as referred to herein means an ester of an aliphatic alcohol having from 1 carbon atom to 8 carbon atoms.

Also, of the foregoing polyols, as the polyol which is used for the purpose of obtaining the non-crystalline polyester resin, it is preferable to use polytetramethylene glycol, bisphenol A, bisphenol Z, hydrogenated bisphenol A, cyclohexanedimethanol or the like.

Also, examples of the non-crystalline resin include polycondensates of a hydroxycarboxylic acid.

Specific examples of the hydroxycarboxylic acid include hydroxyheptanoic acid, hydroxyoctanoic acid, hydroxydecanoic acid, hydroxyundecanoic acid and lactic acid. Of these, it is preferable to use lactic acid.

Also, the non-crystalline polyester resin or crystalline polyester resin is easily obtainable through a combination of the foregoing polycondensable monomers.

In order to prepare a single kind of a polycondensation resin, each of the polyvalent carboxylic acid and the polyol may be used singly; one side of them may be used singly, with the other side being used in combinations of two or more kinds thereof; or each of them may be used in combinations of two or more kinds thereof. Also, in the case where a hydroxycarboxylic acid is used for the purpose of preparing a single kind of a polycondensation resin, a single kind of the hydroxycarboxylic acid may be used singly or in combinations of two or more kinds thereof, or may be used in combination with a polyvalent carboxylic acid or a polyol.

In the case where a crystalline polyester resin and a non-crystalline polyester resin are mixed and subjected to a polymerization reaction to obtain a block copolymer, a crystal melting temperature of the crystalline polyester resin is preferably from 40° C. to 150° C., more preferably from 50° C. to 120° C., and especially preferably from 50° C. to 90° C.

The melting temperature of the crystalline polyester resin is measured according to the differential scanning calorimetry (DSC) by, for example, "DSC-20" (manufactured by Seiko Instruments Inc.). Specifically, the melting temperature is determined as a melting peak temperature in the measurement of input compensation differential scanning calorimetry shown in JIS K-7121:87 in performing the measurement of about 10 mg of a sample by elevating the temperature from room temperature to 150° C. at a constant temperature rising rate (10° C./min). There may be the case where the crystalline resin includes one showing plural melting peaks. In such case, a maximum peak thereof is regarded as the melting temperature in the present exemplary embodiment.

On the contrary, in the case where a crystalline polyester resin and a non-crystalline polyester resin are mixed and subjected to a polymerization reaction to obtain a block copolymer, a glass transition temperature Tg of the non-crystalline polyester resin is preferably from 50° C. to 80° C., and more preferably from 50° C. to 65° C.

Here, the glass transition temperature of the non-crystalline resin refers to a value as measured by the method (DSC method) defined in ASTM D3418-82.

Also, the glass transition temperature in the present exemplary embodiment is measured according to the differential scanning calorimetry (DSC) by, for example, "DSC-20" (manufactured by Seiko Instruments Inc.). Specifically, the glass transition temperature is obtained from a point of intersection of a base line with an inclination line of an endothermic peak by heating about 10 mg of a sample at a constant temperature rising rate (10° C./min).

Also, in the present exemplary embodiment, the glass transition temperature of the block copolymer is preferably from 50° C. to 80° C., and more preferably from 50° C. to 65° C.

Also, the melting temperature of the block copolymer is preferably from 50° C. to 100° C., and more preferably from 50° C. to 80° C. What the melting temperature of the block copolymer falls within the foregoing range is preferable because cleaning properties are enhanced.

In the block copolymer, there may be the case where the melting temperature and the glass transition temperature are not distinctly observed.

In the case where the crystalline polyester resin and the non-crystalline polyester resin are mixed and subjected to a polymerization reaction to obtain a block copolymer, a weight average molecular weight Mw of the crystalline polyester resin to be mixed is preferably from 1,000 to 100,000, and more preferably from 1,500 to 10,000. Also, a weight average molecular weight Mw of the non-crystalline polyester resin to be mixed is preferably 1,000 to 100,000, and more preferably from 2,000 to 10,000.

A weight average molecular weight Mw of the polyester based block copolymer is preferably from 5,000 to 500,000, and more preferably from 5,000 to 50,000.

Also, the polyester based block copolymer may be partially branched or crosslinked by selection of a carboxylic acid valence or an alcohol valence of monomers, addition of a crosslinking agent or the like.

Values of a weight average molecular weight Mw and a number average molecular weight Mn are determined by known various methods. Though there is a slight difference depending upon a divergence of the measurement method, in the present exemplary embodiment, it is preferable to determine the values of a weight average molecular weight Mw and a number average molecular weight Mn according to the following measurement method. That is, the weight average molecular weight Mw and the number average molecular weight Mn are measured under the following condition by means of gel permeation chromatography (GPC). The measurement is carried out by allowing a solvent (for example, tetrahydrofuran) to flow at a flow rate of 1.2 mL per minute at a temperature of 40° C. and injecting 3 mg of a tetrahydrofuran sample solution in a concentration of 0.2 g/20 mL in terms of a sample weight. In measuring the molecular weight of the sample, a measurement condition under which the molecular weight which the instant sample has is included within the range where a relationship between a logarithm of molecular weight of a calibration curve prepared from several kinds of monodispersed polystyrene standard samples and a count number is a straight line is chosen.

The reliability of the measurement results is confirmed from the fact that an NBS706 polystyrene standard sample measured under the foregoing measurement condition has a weight average molecular weight Mw of $28.8\times10^4$ and a number average molecular weight Mn of $13.7\times10^4$.

Also, as a column of GPC to be used, any column may be employed so far as it meets the foregoing conditions. Specifically, for example, a TSK-GEL GMH column (manufactured by Tosoh Corporation), etc. is useful.

The solvent and the measurement temperature are not limited to the foregoing conditions and may be changed to those which are appropriate.

Each of the crystalline polyester resin and the non-crystalline polyester resin is manufactured by subjecting a polyol and a polyvalent carboxylic acid to a polycondensation reaction in the usual way. It is possible to achieve this polycondensation reaction by a general polycondensation method such as polymerization in water, for example, bulk polymerization, emulsion polymerization, suspension polymerization, etc., solution polymerization and interfacial polymerization. Of these, bulk polymerization is preferably adoptive. Also, though the reaction can be performed under atmospheric pressure, in the case where it is aimed to realize a high molecular weight of the obtained polyester molecule, a general condition such as one under a reduced pressure and one in a nitrogen gas stream is useful.

Specifically, each of the crystalline polyester resin and the non-crystalline polyester resin is manufactured by charging the foregoing polyhydric alcohol and polyvalent carboxylic acid and optionally, a catalyst; blending them in a reactor equipped with a thermometer, a stirrer and a down flow condenser; heating the mixture in the presence of an inert gas (for example, a nitrogen gas, etc.); continuously eliminating a low-molecular weight compound formed as a by-product outside the reaction system; and stopping the reaction at a point where the reaction mixture reaches a prescribed acid value, followed by cooling to obtain a desired reaction product.

[(B) Resin Obtained by at Least Aggregating Resin Particles Having a Core-Shell Structure in which a Difference Between a Glass Transition Temperature of a Resin Constituting a Core and a Glass Transition Temperature of a Resin Constituting a Shell is 20° C. or More]

As the binder resin, (B) a resin obtained by at least aggregating resin particles having a core-shell structure in which a difference between a glass transition temperature of a resin constituting a core and a glass transition temperature of a resin constituting a shell is 20° C. or more is preferably useful.

The core-shell particle is preferably a particle in which a difference between a glass transition temperature of a resin constituting a core and a glass transition temperature of a resin constituting a shell is 20° C. or more. When a temperature difference of the glass transition temperature is 20° C. or more, a plastic behavior against pressure is revealed.

In emulsion polymerization, by adopting a method of feeding stepwise monomers to a polymerization system, the method of which is called two-stage feed, or the like, a core-shell particle composed of resins having a different Tg between the core and the shell is obtainable.

However, when mixing processing of a core-shell particle is carried out at a high temperature under a high pressure as in a kneading method for the toner formation in the conventional technologies, a precisely formed phase separation structure collapses so that desired characteristics are not obtainable.

For that reason, as the manufacturing method of a toner, a manufacturing method by granulation in a liquid composed of water, etc as a medium is adequate.

In order to achieve the toner formation by a solution suspension method or an emulsion polymerization aggregation method using the obtained core-shell particle as a raw material of the binder resin, the conventionally known manufacturing methods described in the following documents are adoptive.

"Core-Shell Polymer Nanoparticles for Baroplastic Processing", *Macromolecules,* 2005, 38, 8036 to 8044

"Preparation and Characterization of Core-Shell Particles Containing Perfluoroalkyl Acrylate in the Shell", *Macromolecules,* 2002, 35, 6811 to 6818

"Complex Phase Behavior of a Weakly Interacting Binary Polymer Blend", *Macromolecules,* 2004, 37, 5851 to 5855

Specific examples of the combination of resins having a different Tg from each other by 20° C. or more include a combination of polystyrene and polybutyl acrylate, a combination of polystyrene and polybutyl methacrylate, a combination of polystyrene and poly(2-ethylhexyl acrylate), a combination of polystyrene and polyhexyl methacrylate, a combination of polyethyl methacrylate and polyethyl acrylate and a combination of polyisoprene and polybutylene.

In the core-shell particle composed of such a combination, the pressure plasticization behavior is observed even when any one of the resins constitutes the shell or the core. However, in order to make both toner formation and durability at the time conveyance or storage compatible with each other, it is preferable that the high-Tg phase constitutes the shell side.

Also, for the purpose of using such a core-shell particle in a proportion of 50% or more in terms of a composition in the toner, it is necessary to impart controllability to the core-shell particle at the time of toner formation in water, namely controllability of grain size and grain size distribution. In order to achieve this, for the purpose of achieving easy control by the addition of an aggregating agent, it is effective to contain an acidic or basic polar group or an alcoholic hydroxyl group into the resin. Such is realized chiefly by copolymerizing a shell component with a monomer having such a polar group.

As the acidic polar group, a carboxyl group, a sulfonic group, an acid anhydride group and the like are preferably exemplified. Of these, a carboxyl group is more preferable.

Examples of the monomer for forming an acidic polar group in the resin include α,β-ethylenically unsaturated compounds having a carboxyl group or a sulfone group.

Specific examples thereof include acrylic acid, methacrylic acid, fumaric acid, maleic acid, itaconic acid, cinnamic acid, sulfonated styrene and allylsulfosuccinic acid.

As the basic polar group, an amino group, an amide group, a hydrazide group and the like are preferably exemplified.

Examples of the monomer for forming a basic polar group in the resin include monomer structural units having a nitrogen atom (hereinafter also referred to as "nitrogen-containing monomer").

Examples of the compound which is preferably used as the monomer include (meth)acrylic acid amide compounds, (meth)acrylic acid hydrazide compounds and aminoalkyl (meth)acrylate compounds.

Examples of the (meth)acrylic acid amide compound include acrylic acid amide, methacrylic acid amide, acrylic acid methylamide, methacrylic acid methylamide, acrylic acid dimethylamide, acrylic acid diethylamide, acrylic acid phenylamide and acrylic acid benzylamide.

Examples of the (meth)acrylic acid hydrazide compound include acrylic acid hydrazide, methacrylic acid hydrazide, acrylic acid methylhydrazide, methacrylic acid methylhydrazide, acrylic acid dimethylhydrazide and acrylic acid phenylhydrazide.

Examples of the aminoalkyl(meth)acrylate compound include (2-aminoethyl)(meth)acrylate.

As the monomer for forming an alcoholic hydroxyl group, hydroxy acrylates are preferable. Specific examples thereof include 2-hydroxyethyl(meth)acrylate, hydroxypropyl (meth)acrylate and hydroxybutyl(meth)acrylate.

A use amount of the monomer having a polar group is preferably in the range of from 0.01% by weight to 20% by weight, and more preferably from 0.1% by weight to 10% by weight of the total weight of the polymerizable monomers used in the shell layer. When the use amount of the monomer having a polar group falls within the foregoing range, stability to the core-shell particle in an aqueous medium is excellent.

Such a pressure plastic core-shell particle may be used singly as a raw material of the binder resin, or may be used upon being mixed with a conventional type resin particle by emulsion polymerization. In that case, a ratio of the resin obtained by aggregating the core-shell particles is preferably 30% by weight or more, and more preferably from 50% by weight to 100% by weight in the whole of the binder resin for the purpose of attaining the object.

The Tg of the high-Tg phase is preferably in the range of from 45° C. to 80° C., and more preferably from 50° C. to 70° C.

Also, the Tg of the low-Tg phase is preferably lower than the Tg of the high-Tg phase by 30° C. or more.

A weight average molecular weight Mw of the resin which is used for the core is preferably from 3,000 to 50,000, and more preferably from 5,000 to 40,000.

A weight average molecular weight Mw of the resin which is used for the shell is preferably from 3,000 to 50,000, and more preferably from 5,000 to 40,000.

In the core-shell particle, a weight ratio of the resin constituting the core and the resin constituting the shell is preferably from 10/90 to 90/10, and more preferably from 20/80 to 80/20 in terms of a core/shell ratio.

[(C) Resin Mixture in which a Sea-Island Structure is Formed of Two Kinds of Resins Having a Difference in a Glass Transition Temperature of 20° C. or More from Each Other]

As the binder resin, (C) a resin mixture in which a sea-island structure is formed of two kinds of resins having a difference in a glass transition temperature of 20° C. or more from each other is preferable.

A length of the major axis of the island phase in the resin mixture in which a sea-island structure is formed is preferably not more than 150 nm, and more preferably from 1 nm to 150 nm.

The resin to be contained in the resin mixture in which a sea-island structure is formed may be a (co)polymer obtained from an ethylenically unsaturated compound, or may be a (co)polymer obtained from a diol and a dicarboxylic acid.

With respect to the resin mixture in which a sea-island structure is formed, it is preferable that an island phase is formed from a low-Tg resin as a minor component, whereas a sea phase as a continuous phase is formed from a high-Tg resin.

Also, with respect to the resin mixture in which a sea-island structure is formed, it is more preferable that a sea-island structure is formed; that a difference between a glass transition temperature of a resin constituting a sea phase and a glass transition temperature of a resin constituting an island phase is 30° C. or more; that all of the glass transition temperatures of the resins are lower than 55° C.; and that a length of the major axis of the island phase is not more than 150 nm.

A ratio of a weight of the resin constituting an island phase to a weight of the resin constituting a sea phase is preferably 0.25 or more.

The resin mixture in which a sea-island structure is formed is suitably obtained by a manufacturing method including a dispersion step of dispersing a high-Tg resin particle and a low-Tg resin particle in an aqueous medium; an aggregation step of aggregating the two kinds of the dispersed resin particles to obtain an aggregated particle; and a fusion step of heat fusing the aggregated particle to form a sea-island structure, wherein all of the resin particles have a median size of not more than 100 nm, and a length of the major axis of an island phase included in the sea-island structure is not more than 150 nm.

Also, the binder resin which is used in the present exemplary embodiment is preferably a resin which satisfies the relationship of the following expression (3).

$$\Delta T_p = T_{p1} - T_{p5} \geqq 20° \text{ C.} \quad (3)$$

In the expression (3), $T_{p1}$ represents a temperature at which a melt viscosity of the resin as measured at a load of 1 MPa (10 kgf/cm$^2$) by the flow tester method reaches 10,000 Pa·s; and $T_{p5}$ represents a temperature at which a melt viscosity of the resin as measured at a load of 5 MPa (50 kgf/cm$^2$) by the flow tester method reaches 10,000 Pa·s.

In the expression (3), $\Delta T_p$ is 20° C. or more, preferably from 20° C. to 120° C.; more preferably from 30° C. to 110° C.; and further preferably from 40° C. to 100° C.

Also, a content of the binder resin in the electrostatic-image-developing toner which is used in the present exemplary embodiment is preferably from 10% by weight to 90% by weight, more preferably from 30% by weight to 85% by weight, and further preferably from 50% by weight to 80% by weight relative to the total weight of the toner.

In the image forming method according to the present exemplary embodiment, it is preferable that the binder resin of a toner is formed of at least a high-Tg component and a low-Tg component; that a ratio $\{(Mn(HTg)/Mn(LTg))_B\}$ of a number average molecular weight of the high-Tg component to a number average molecular weight of the low-Tg component in the binder resin before the irradiation step is not more than about 1.5; and that a ratio $\{(Mn(HTg)/Mn(LTg))_A\}$ of a number average molecular weight of the high-Tg component to a number average molecular weight of the low-Tg component in the binder resin after the irradiation step is more than about 1.5.

Also, a fixing pressure is preferably from about 1 MPa to about 5 MPa.

(Coloring Agent)

The electrostatic-image-developing toner which is used in the present exemplary embodiment contains a coloring agent.

Specific examples of the coloring agent include various pigments such as carbon black, Chrome Yellow, Hansa Yellow, Benzidine Yellow, Threne Yellow, Quinoline Yellow, Permanent Orange GTR, Pyrazolone Orange, Vulcan Orange, Watchung Red, Permanent Red, Brilliant Carmine 3B, Brilliant Carmine 6B, Du Pont Oil Red, Pyrazolone Red, Lithol Red, Rhodamine B Lake, Lake Red C, Rose Bengale, Aniline Blue, Ultramarine Blue, Chalco Oil Blue, Methylene Blue Chloride, Phthalocyanine Blue, Phthalocyanine Green, Malachite Green Oxalate and Titanium Black; and various dyes such as acridine based dyes, xanthene based dyes, azo based dyes, benzoquinone based dyes, azine based dyes, anthraquinone based dyes, thioindigo based dyes, dioxazine based dyes, thiazine based dyes, azomethine based dyes, indigo based dyes, thioindigo based dyes, phthalocyanine based dyes, aniline black based dyes, polymethine based dyes, triphenylmethane based dyes, diphenylmethane based dyes, thiazine based dyes, thiazole based dyes and xanthene based dyes. Specifically, for example, carbon black, a nigrosine dye (C.I. No. 50415B), Aniline Blue (C.I. No. 50405), Chalco Oil Blue (C.I. No. azoic Blue 3), Chrome Yellow (C.I. No. 14090), Ultramarine Blue (C.I. No. 77103), Du Pont Oil Red (C.I. No. 26105), Quinoline Yellow (C.I. No. 47005), Methylene Blue Chloride (C.I. No. 52015), Phthalocyanine Blue (C.I. No. 74160), Malachite Green Oxalate (C.I. No. 42000), Lamp Black (C.I. No. 77266), Rose Bengale (C.I. No. 45435) and mixtures thereof are preferably useful as the coloring agent.

A use amount of the coloring agent is preferably from 0.1 parts by weight to 20 parts by weight, and especially preferably from 0.5 parts by weight to 10 parts by weight based on 100 parts by weight of the toner.

Also, as the coloring agent, such a pigment or dye or the like can be used singly or in combinations of two or more kinds thereof.

A dispersion method thereof is not restricted at all, and an arbitrary method, for example, general dispersion methods using a rotary shear type homogenizer, a media-containing ball mill, a sand mill, a Dyno-Mill, etc. may be used. Also, such a color agent particle may be added at once in a mixed solvent together with other particle components, or may be divided and added in a multistage manner.

In the present exemplary embodiment, the electrostatic-image-developing toner may contain a magnetic material or a charge controlling agent, if desired.

Examples of the magnetic material include a metal or alloy exhibiting ferromagnetic properties, such as iron, cobalt and nickel, including ferrite and magnetite; a compound containing such an element; an alloy not containing a ferromagnetic element but exhibiting ferromagnetic properties upon being subjected to an appropriate heat treatment, for example, an alloy of the type called a Whisler alloy containing manganese and copper, such as manganese-copper-aluminum and manganese-copper-tin; chromium dioxide; and others. For example, in the case of obtaining a black toner, magnetite which is black itself and which also reveals a function as a coloring agent is especially preferably useful. Also, in the case of obtaining a color toner, a magnetic material with little blackish tint, such as metallic iron, is preferable. Also, some of these magnetic materials function as a coloring agent, and in that case, the magnetic material may be used so as to also serve as the coloring agent. In the case of a magnetic toner, a content of such a magnetic material is preferably from 20 parts by weight to 70 parts by weight, and more preferably from 40 parts by weight to 70 parts by weight based on 100 parts by weight of the toner.

As the charge controlling agent, those which are conventionally known, inclusive of positively chargeable charge controlling agents such as nigrosine based dyes, quaternary ammonium salt based compounds, triphenylmethane based compounds, imidazole based compounds and polyamine based resins; and negatively chargeable charge controlling agent such as metal-containing azo based dyes of chromium, cobalt, aluminum, iron, etc., metal salts or metal complexes of chromium, zinc, aluminum, etc. with a hydroxycarboxylic acid (for example, salicylic acid, an alkyl salicylic acid, benzilic acid, etc.), amide compounds, phenol compounds, naphthol compounds and phenol amide compounds, are useful.

Furthermore, in the present exemplary embodiment, it is preferable that the toner is used upon being mixed with an inorganic particle such as a fluidity enhancing agent.

A primary grain size of the inorganic particle is preferably from 5 nm to 2 μm, and more preferably from 5 nm to 500 nm. Also, a specific surface area of the inorganic particle by the BET (Brunauer-Emmett-Teller) method is preferably from 20 $m^2/g$ to 500 $m^2/g$. A proportion of the inorganic particle to be mixed in the toner is preferably from 0.01% by weight to 5% by weight, and more preferably from 0.01% by weight to 2.0% by weight.

Examples of such an inorganic particle include a silica powder, alumina, titanium oxide, barium titanate, magnesium titanate, calcium titanate, strontium titanate, zinc oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride. Of these, a silica powder is especially preferable.

The silica powder as referred to herein means a powder having an Si—O—Si bond and includes both a silica powder manufactured by a dry method and a silica powder manufactured by a wet method. Also, in addition to anhydrous silicon dioxide, the silica powder may be any of aluminum silicate, sodium silicate, potassium silicate, magnesium silicate or zinc silicate, but a silica powder containing 85% by weight or more of $SiO_2$ is preferable. Specific examples of such a silica powder include commercially available various silicas, and those having a hydrophobic group on the surface thereof, for example, AEROSIL R-972, R-974, R-805 and R-812 (all of which are manufactured by Aerosil Co.), TALAX 500 (manufactured by Talco Co.), etc., are preferable. Besides, for example, a silica powder treated with a silane coupling agent, a titanium coupling agent, a silicon oil, a silicon oil having an amine in a side chain thereof, etc. may be used.

Also, the electrostatic-image-developing toner may be used in combinations with a release agent, if desired. In that case, the release agent may be added in the form of an aqueous dispersion or the like, for example, at the time of initiation of manufacture of the monomer emulsion, at the time of initiation of polymerization, at the time of initiation of aggregation of the polymer particle or the like.

Examples of other release agents include known release agents inclusive of polyolefin based waxes such as low-molecular weight polyethylene, low-molecular weight polypropylene and an ethylene-propylene copolymer; vegetable waxes such as paraffin based waxes other than the foregoing specified paraffins, hydrogenated castor oil, carnauba wax and rice wax; higher fatty acid ester based waxes such as stearic acid esters, behenic acid esters and montanic acid esters; alkyl-modified silicones; higher alcohols of stearic acid or the like, such as higher fatty acid stearyl alcohol; higher fatty acid amides other than the foregoing specified fatty acid amides; and ketones having a long-chain alkyl group, such as distearyl ketone.

Furthermore, in the electrostatic-image-developing toner, known various internal additives which are used for this type of toner, such as antioxidants and ultraviolet absorbents, may be used, if desired.

An accumulated volume average grain size (median size) $D_{50}$ of the electrostatic-image-developing toner according to the present exemplary embodiment is preferably in the range of from 3.0 μm to 9.0 μm, and more preferably from 3.0 μm to 5.0 μm. When the accumulated volume average grain size $D_{50}$ of the electrostatic-image-developing toner falls within the foregoing range, an adhesive strength is adequate, developability is favorable, and resolution properties of an image is excellent.

Also, a volume average grain size distribution index $GSD_v$ of the electrostatic-image-developing toner according to the present exemplary embodiment is preferably not more than 1.30, more preferably not more than 1.24, and further preferably not more than 1.20. When the $GSD_v$ is not more than 1.30, resolution properties are excellent, and image defects such as toner scattering and fog (toner adhesion of a portion which is originally a non-image area) are not caused.

Here, the accumulated volume average grain size $D_{50}$ and the average grain size distribution index are measured by an analyzer, for example, Coulter Multimizer II (manufactured by Beckman Coulter K.K.), etc. The accumulated distributions of volume and number of particles are drawn from the smaller particle side to the grain size range (channel) divided on the basis of the grain size distribution, and the grain size of accumulation of 16% is defined as volume $D_{16v}$ and number $D_{16p}$; the grain size of accumulation of 50% is defined as volume $D_{50v}$ and number $D_{50p}$; and the grain size of accumulation of 84% is defined as volume $D_{84v}$ and number $D_{84p}$, respectively. By using these values, a volume average grain size distribution index ($GSD_v$) is computed as $(D_{84v}/D_{16v})^{1/2}$, and a number average grain size distribution index ($GSD_p$) is computed as $(D_{84p}/D_{16p})^{1/2}$.

In the present exemplary embodiment, in view of image forming properties, a shape factor SF1 of the electrostatic-image-developing toner is preferably from 100 to 140, and more preferably from 110 to 135.

The shape factor SF1 is digitized by chiefly analyzing a microscopic image or a scanning electron microscopic image by an image analyzer and determined by, for example, the following manner. That is, for the measurement of the shape factor SF1, an optical microscopic image of the toner sprayed on a slide glass is first taken into a Luzex image analyzer via a video camera, SF1 is computed according to the following expression as to 50 or more toners, and an average value is then determined therefrom.

$$SF1=\{(ML)^2/A\}\times(\pi/4)\times 100$$

In the foregoing expression, ML represents an absolute maximum length of the toner particle; and A represents a projected area of the toner particle.

In the present exemplary embodiment, for the purposes of imparting fluidity and enhancing cleaning properties, the electrostatic-image-developing toner is used by drying the toner likewise a usual toner and then adding an inorganic particle of, for example, silica, alumina, titania, calcium carbonate, etc. or a resin particle of, for example, a vinyl based resin, a polyester, a silicone, etc. onto the surface of the toner particle while applying a shear in a dry state.

Also, in the case where the particle is made to adhere to the toner surface in an aqueous medium, so far as the inorganic particle is concerned, all of materials which are in general used as an external additive on the toner surface, such as silica, alumina, titania, calcium carbonate, magnesium carbonate and tricalcium phosphate, are used upon being dispersed with an ionic surfactant, a polymer acid or a polymer base.

(Manufacturing Method of Electrostatic-Image-Developing Toner)

The manufacturing method of an electrostatic-image-developing toner preferably includes at least a step of emulsifying and dispersing a binder resin in an aqueous medium to obtain a resin particle dispersion; a step of obtaining a coloring agent particle dispersion; a step of obtaining a release agent particle dispersion; a step of obtaining an aggregated particle in which these particles are aggregated (hereinafter also referred to as "aggregation step"); and a step of fusing the aggregated particle by heating (hereinafter also referred to as "fusion step").

The electrostatic-image-developing toner is obtained by, for example, mixing a prepared resin particle dispersion with a coloring agent particle dispersion and a release agent particle dispersion; further adding an aggregating agent to cause heterogeneous aggregation, thereby forming an aggregated particle with a toner diameter; and thereafter, fusing and coalescing the aggregated particle by heating at a temperature of a glass transition temperature the resin particle or higher or a melting temperature of the resin particle or higher, followed by washing and drying. As to the toner shape, from an amorphous shape to a spherical shape may be properly used. Also, as the aggregating agent, in addition to a surfactant, an inorganic salt and a divalent or polyvalent metal salt are suitably useful. In particular, the case of using a metal salt is preferable in view of characteristics of control of aggregation properties and toner chargeability.

Also, it is possible to adopt a method in which in the aggregation step, the resin particle dispersion and the coloring agent dispersion are previously aggregated to form a first aggregated particle; and thereafter, the resin particle dispersion or another resin particle dispersion is added to form a second shell layer on the surface of the first particle. In this exemplification, though the coloring agent dispersion is separately prepared, as a matter of course, the coloring agent may be previously blended in the resin particle in the resin particle dispersion.

In the present exemplary embodiment, the forming method of an aggregated particle is not particularly limited, and known aggregation methods which are conventionally adopted in the emulsion polymerization aggregation method of an electrostatic-image-developing toner, for example, a method of reducing stability of an emulsion by temperature elevation, pH change, salt addition, etc. and stirring the emulsion with a disperser or the like, are adoptive. Furthermore, after the aggregation treatment, for the purpose of, for example, suppressing bleed-out of the coloring agent from the particle surface, a heat treatment or the like may be applied, thereby crosslinking the particle surface. The used surfactant and the like used may be removed by water washing, acid washing, alkali washing or the like, if desired.

In the manufacturing method of the electrostatic-image-developing toner according to the present exemplary embodiment, a charge controlling agent which is used for this type of toner may be used, if desired. In that case, the charge controlling agent may be added in the form of an aqueous dispersion or the like, for example, at the time of initiation of manufacture of the monomer particle emulsion, at the time of initiation of polymerization, at the time of initiation of aggregation of the resin particle or the like. The addition amount of the charge controlling agent is preferably from 1 part by weight to 25 parts by weight, and more preferably from 5 parts by weight to 15 parts by weight based on 100 parts by weight of the monomer or polymer.

As the charge controlling agent, those described above are suitably useful.

In the present exemplary embodiment, a median size of the resin particle in the resin particle dispersion which is used in the manufacturing method of an electrostatic-image-developing toner is preferably from 0.1 μm to 2.0 μm.

In the case of using an addition polymerization based monomer for the purpose of preparing an addition polymerization based resin particle dispersion, the resin particle dispersion may be prepared by carrying out emulsion polymerization using an ionic surfactant or the like. In the case of other resins, so far as the resin is oily and soluble in a solvent having relatively low solubility in water, the resin is dissolved in such a solvent and dispersed together with an ionic surfactant and an polymer electrolyte in a particle form in an aqueous medium by using a dispersing machine such as a homogenizer, and thereafter, the solvent is evaporated by heating or under a reduced pressure, thereby obtaining a resin particle dispersion. Also, at the time of polymerization of an addition polymerization based monomer, a known polymerization initiator or chain transfer agent may be used.

In the fusion step to be carried out after the aggregation step, a pH of a suspension containing the aggregated particle formed after the foregoing steps is regulated so as to fall within a desired range, thereby stopping progress of the aggregation, and heating is then carried out to fuse the aggregated particle.

The pH is regulated by the addition of an acid and/or an alkali. Though the acid to be used is not particularly limited, an aqueous solution containing an inorganic acid such as hydrochloric acid, nitric acid and sulfuric acid in an amount in the range of from 0.1% by weight to 50% by weight is preferable. Also, though the alkali to be used is not particularly limited, an aqueous solution containing an alkali metal hydroxide such as sodium hydroxide and potassium hydroxide in an amount in the range of from 0.1% by weight to 50% by weight is preferable.

In the pH regulation, there may be the case where when a local pH change occurs, local breakage of the aggregated particle itself or local excessive aggregation is caused, and deterioration of shape distribution is brought. In particular, the amount of the acid and/or alkali to be added increases as the scale becomes large. In general, since a place where the acid or alkali is charged is one place, so far as the treatment is performed for the same time, the concentration of the acid or alkali in the charge place increases as the scale becomes large.

After the foregoing pH regulation, the aggregated particle is fused (coalesced) by heating. It is preferable that the aggregated particle is fused by heating at a higher temperature than the glass transition temperature of the binder resin by from 10° C. to 50° C. (in other words, at a temperature which is higher than the glass transition temperature by from 10° C. to 50° C.).

After completion of the fusion step of the aggregated particle, a desired toner particle (toner mother particle) is obtained after arbitrarily passing through a washing step, a solid-liquid separation step and a drying step. Taking into consideration the chargeability, the washing step is preferably performed by displacement and washing with ion exchanged water. Also, though the solid-liquid separation step is not particularly limited, in view of productivity, suction filtration, pressure filtration or the like is suitable. Furthermore, though the drying step is also not particularly limited, in view of productivity, freeze drying, flash jet drying, fluidized drying, vibration type fluidized drying and the like are preferably adoptive. Also, the various external additives as already described may be added to the toner particle (toner mother particle) after drying, if desired.

<Electrostatic Image Developer>

In the present exemplary embodiment, the electrostatic-image-developing toner may also be used as an electrostatic image developer. This developer is not particularly limited, except for the fact that it contains this electrostatic-image-developing toner and takes a proper component composition depending upon the purpose. When the electrostatic-image-developing toner is used singly, the developer is prepared as an electrostatic image developer of a single-component system; and when the electrostatic-image-developing toner is used in combination with a carrier, the developer is prepared as an electrostatic image developer of a two-component system.

The carrier which is used in the present exemplary embodiment is not particularly limited. Examples thereof include a magnetic material particle (for example, an iron powder, ferrite, an iron oxide powder, nickel, etc.); a resin-coated carrier obtained by using a magnetic material particle as a core and coating the surface thereof with a resin (for example, styrene based resins, vinyl based resins, ethylene based resins, rosin based resins, polyester based resins, melamine based resins, etc.) or a wax (for example, stearic acid, etc.) to form a resin-coated layer; and a magnetic material-dispersed carrier obtained by dispersing a magnetic material particle in a binder resin. Of these, the resin-coated carrier is especially preferable because it is possible to control chargeability of the toner or resistance of the whole of the carrier due to the configuration of the resin-coated layer. In the electrostatic image developer of a two-component system, as to a mixing proportion of the toner according to the present exemplary embodiment to the carrier, the toner is preferably used in an amount of from 2 parts by weight to 10 parts by weight based on 100 parts by weight of the carrier. Also, a method for preparing the developer is not particularly limited, and examples thereof include a method of mixing using a V-blender, etc.

As the carrier which is used in the present exemplary embodiment, it is preferable to use a magnetic material-dispersed carrier in which a magnetic material such as magnetite is dispersed as a core of the carrier in a resin (carrier whose core is constituted of a magnetic material-dispersed particle).

The core in the magnetic material-dispersed carrier is a magnetic powder-dispersed particle in which a magnetic material particle is dispersed in a resin.

(1) Core:

As a material of the magnetic material to be dispersed in the core, for example, a magnetic metal such as iron, steel, nickel and cobalt; an alloy thereof with manganese, chromium, a rare earth element, etc. (for example, a nickel-iron alloy, a cobalt-iron alloy, an aluminum-iron alloy, etc.); a magnetic oxide such as ferrite and magnetite; and the like may be applied. Of these, iron oxide is preferable. What the magnetic material particle is an iron oxide particle is advantageous in view of the facts that characteristics are stable and that toxicity is low.

Such a magnetic material may be used singly or in combinations of two or more kinds thereof.

A grain size of the magnetic material to be dispersed is preferably from 0.01 μm to 1 μm, more preferably from 0.03 μm to 0.5 μm, and further preferably from 0.05 μm to 0.35 μm. When the grain size of the magnetic material to be dispersed falls within the foregoing range, saturation magnetization is sufficient, the viscosity of a composition (monomer mixture) is adequate, and a carrier with a uniform grain size is easily obtainable.

A content of the magnetic material in the magnetic powder-dispersed particle is preferably from 30% by weight to 99% by weight, more preferably from 45% by weight to 97% by weight, and further preferably from 60% by weight to 95% by weight. When the content of the magnetic material in the magnetic powder-dispersed particle falls within the foregoing range, scattering of the magnetic material-dispersed carrier or the like is suppressed, and breakage of the magnetic material-dispersed carrier is suppressed.

Examples of the resin component in the magnetic powder-dispersed particle include a crosslinked styrene based resin, an acrylic resin, a styrene-acrylic copolymer resin and a phenol based resin.

The magnetic powder-dispersed particle may further contain, in addition to the matrix and the magnetic powder, other components depending upon the purpose. Examples of other components include a charge controlling agent and a fluorine-containing particle.

A volume average grain size of the core in the carrier according to a first embodiment is preferably in the range of from 10 μm to 500 μm, more preferably in the range of from 30 μm to 150 μm, and further preferably in the range of from 30 μm to 100 μm. When the volume average grain size of the core according to a first embodiment falls within the foregoing range, transfer of the carrier into the photoconductor is suppressed; productivity is excellent; and the formation of a streak originated from the carrier, which is called a brush mark, and the formation of an image with rough feel are prevented from occurring.

The volume average grain size of the core is a value as measured using a laser diffraction/scattering grain size distribution analyzer (LS Grain size Analyzer: LS13 320, manufactured by Beckman Coulter K.K.). When the accumulated distribution of volume of particles is drawn from the smaller particle side to the grain size range (channel) divided on the basis of the obtained grain size distribution, the grain size of accumulation of 50% is defined as a volume average grain size $D_{50v}$.

As a method for manufacturing the magnetic powder-dispersed particle, for example, there are known a melt kneading method in which a magnetic material powder and a binder resin such as a styrene-acrylic resin are melt kneaded using a Banbury mixer, a kneader, etc., and after cooling, the mixture is pulverized and then classified (see, for example, JP-B-59-24416, JP-B-8-3679, etc.); a suspension polymerization method in which a monomer unit of a binder resin and a magnetic material powder are dispersed in a solvent to prepare a suspension, and this suspension is polymerized (see, for example, JP-A-5-100493, etc.); a spray drying method in which a magnetic material powder is mixed and dispersed in a resin solution, and the dispersion is spray dried; and so on.

It is preferable that all of the melt kneading method, the suspension polymerization method and the spray drying method include a step of previously preparing a magnetic material powder by some kind of measure and mixing this magnetic material powder and a resin solution, thereby dispersing the magnetic material powder in the resin solution.

(2) Coating Layer:

The magnetic powder-dispersed carrier preferably has the foregoing core (magnetic powder-dispersed particle) and a coating layer on the surface thereof. The coating layer is preferably a coating resin layer which is formed of a matrix resin.

A coverage of the core by the coating layer is preferably 95% or more, and more preferably 97% or more. When the coverage of the core by the coating layer falls within the foregoing range, a portion where the core is exposed is few, and breakage or pulverization of the carrier is sufficiently suppressed.

The coverage of the core as referred to in the present exemplary embodiment is a value obtained by measuring a ratio of constitutional elements on the surface of each of the core (not coated) and the carrier (coated) by means of X-ray photoelectron spectroscopy (XPS) and representing it according to the following expression.

$$\text{Coverage}(\%)=\{1-(\text{peak area to be caused due to iron of the carrier})/(\text{peak area to be caused due to iron of the core})\}\times 100$$

An average film thickness of the coating layer is preferably from 0.1 μm to 10 μm, more preferably from 0.1 μm to 3.0 μm, and further preferably from 0.1 μm to 1.0 μm. When the average film thickness of the coating layer falls within the foregoing range, a lowering of the resistance to be caused due to separation of the coating layer at the time of long-term use is suppressed, pulverization of the carrier is sufficiently suppressed, and a time required for the carrier to reach a saturation charge amount is short.

As the matrix resin which is contained in the coating resin layer, a general matrix resin may be used.

Examples thereof include polyolefin based resins such as polyethylene and polypropylene; polyvinyl or polyvinylidene based resins such as polystyrene, acrylic resins, polyacrylonitrile, polyvinyl acetate, polyvinyl alcohol, polyvinyl butyral, polyvinyl chloride, polyvinylcarbazole, polyvinyl ether and polyvinyl ketone; a vinyl chloride-vinyl acetate copolymer; a styrene-acrylic acid copolymer; straight silicon resins composed of an organosiloxane bond or modification products thereof; fluorocarbon resins such as polytetrafluoroethylene, polyvinyl fluoride, polyvinylidene fluoride and polychlorotrifluoroethylene; polyesters; polyurethanes; polycarbonates; phenol resins; amino resins such as urea-formaldehyde resins, melamine resins, benzoguanamine resins, urea resins and polyamide resins; silicone resins; and epoxy resins.

These materials may be used singly or in combinations of two or more kinds thereof.

In particular, with respect to contamination of the toner component, it is preferable to use, as the coating resin, a low-surface energy resin such as fluorocarbon resins and silicone resins. It is more preferable to perform coating with a fluorocarbon resin.

Examples of the fluorocarbon resin include fluorinated polyolefins, fluoroalkyl(meth)acrylate polymers and/or copolymers, vinylidene fluoride polymers and/or copolymers and mixtures thereof. As a fluorine-containing monomer for forming the fluorocarbon resin, a fluorine-containing fluoroalkyl methacrylate based monomer such as tetrafluoropropyl methacrylate, pentafluoropropyl methacrylate, octafluoropentyl methacrylate, perfluorooctylethyl methacrylate and trifluoromethyl methacrylate is suitable. However, it should not be construed that the invention is limited thereto.

A blending amount of the fluorine-containing monomer is preferably in the range of from 0.1% by weight to 50.0% by weight, more preferably in the range of from 0.5% by weight to 40.0% by weight, and further preferably in the range of from 1.0% by weight to 30.0% by weight relative to the whole of monomers constituting the coating resin. When the blending amount of the fluorine-containing monomer falls within the foregoing range, resistance to contamination is sufficiently ensured, adhesion of the coating resin to the core is excellent, and chargeability of the carrier is excellent.

A resin particle may be dispersed and contained in the coating layer.

Examples of the resin particle include thermoplastic resin particles and thermosetting resin particles. Of these, thermosetting resin particles in which the hardness is relatively easily increased are suitable; and for the purpose of imparting negative chargeability to the toner, it is preferable to use a resin particle containing a nitrogen atom. Such a resin particle may be used singly or in combinations of two or more kinds thereof.

It is preferable that the resin particle to be contained in the coating layer is uniformly dispersed in a thickness direction of the coating resin layer and a tangent direction to the carrier surface in the matrix resin. What the resin of the resin particle and the matrix resin have high compatibility with each other is preferable because uniformity of dispersion in the coating resin layer of the resin particle is enhanced.

Examples of the thermoplastic resin include polyolefin based resins such as polyethylene and polypropylene; polyvinyl or polyvinylidene based resins such as polystyrene, acrylic resins, polyacrylonitrile, polyvinyl acetate, polyvinyl alcohol, polyvinyl butyral, polyvinyl chloride, polyvinylcarbazole, polyvinyl ether and polyvinyl ketone; a vinyl chloride-vinyl acetate copolymer; a styrene-acrylic acid copolymer; straight silicon resins composed of an organosiloxane bond or modification products thereof; fluorocarbon resins such as polytetrafluoroethylene, polyvinyl fluoride, polyvinylidene fluoride and polychlorotrifluoroethylene; polyesters; polyurethanes; and polycarbonates.

Examples of the thermosetting resin which is used for the resin particle to be contained in the coating layer include phenol resins; amino resins such as urea-formaldehyde resins, melamine resins, benzoguanamine resins, urea resins and polyamide resins; silicone resins; and epoxy resins.

The resin of the resin particle to be contained in the coating layer and the matrix resin may be made of the same kind of material or a different kind of material. The case where the resin of the resin particle to be contained in the coating layer and the matrix resin are made of a different kind of material from each other is especially preferable.

The use of a thermosetting resin particle as the resin of the resin particle to be contained in the coating layer is preferable because a mechanical strength of the carrier is enhanced. A resin having a crosslinked structure is especially preferable.

Also, for the purpose of making functions of the resin particle as a charge site more favorable, it is preferable to use a resin with fast build up of the toner charge. As such a resin particle, resins of a nitrogen-containing resin such as nylon resins, amino resins and melamine resins are preferable.

The resin particle to be contained in the coating layer is manufactured by a method of manufacturing a granulated resin particle by utilizing polymerization such as emulsion polymerization and suspension polymerization; a method of manufacturing a resin particle by dispersing a monomer or an oligomer in a solvent and granulating it while advancing a crosslinking reaction; a method of manufacturing a resin particle by mixing a low-molecular component and a crosslinking agent and allowing the mixture to react by means of melt kneading or the like and then pulverizing the reaction mixture to a prescribed grain size by a wind force, a mechanical force, etc.; and the like.

A volume average grain size of the resin particle to be contained in the coating layer is preferably from 0.1 μm to 2.0 μm, and more preferably from 0.2 μm to 1.0 μm. When the volume average grain size of the resin particle to be contained in the coating layer falls within the foregoing range, the resin particle is sufficiently dispersed in the coating layer, dropping of the resin particle from the coating layer is suppressed, and stable chargeability is obtainable.

A measurement method of the volume average grain size of the resin particle to be contained in the coating layer is the same as that in the case of the foregoing measurement of the volume average grain size of the core.

A content of the resin particle in the coating layer is preferably from 1% by volume to 50% by volume, more preferably from 1% by volume to 30% by volume, and further preferably from 1% by volume to 20% by volume. When the content of the resin particle in the coating layer falls within the foregoing range, effects of the resin particle are sufficiently revealed, dropping of the resin particle from the coating layer is suppressed, and stable chargeability is obtainable.

A conductive powder may be further dispersed and contained in the coating layer.

Examples of the conductive fine powder include metals such as gold, silver and copper; carbon black; metal oxides such as titanium oxide, magnesium oxide, zinc oxide, aluminum oxide, calcium carbonate, aluminum borate, potassium titanate and calcium titanate powders; and fine powders obtained by covering the surface of titanium oxide, zinc oxide, barium sulfate, aluminum borate, potassium titanate or the like with tin oxide, carbon black or a metal.

These materials may be used singly or in combinations of two or more kinds thereof.

The use of a metal oxide as the conductive fine powder is preferable because environmental dependency of chargeability is more reduced. Above all, titanium oxide is especially preferable.

Furthermore, it is preferable that the conductive powder composed of the foregoing material is treated with a coupling agent. Above all, a coupling agent-treated metal oxide is preferable, and coupling agent-treated titanium oxide is especially preferable.

The coupling agent-treated conductive fine powder is obtained by dispersing an untreated conductive powder in a solvent such as toluene, subsequently mixing and treating with a coupling agent and then drying under a reduced pressure.

Furthermore, the obtained coupling agent-treated conductive powder may be pulverized by a pulverizer, if desired for the purpose of removing an aggregate therefrom. As the pulverizer, known pulverizers such as a pin mill, a disk mill, a hammer mill, a centrifugal mill, a roller mill and a jet mill may be used. Of these, it is especially preferable to use a jet mill. As the coupling agent to be used, known coupling agents such as a silane coupling agent, a titanium coupling agent, an aluminum based coupling agent and a zirconium based coupling agent may be used.

Above all, the use of a conductive powder treated with a silane coupling agent, especially methyltrimethoxysilane is especially effective for environmental stability of the charge.

A volume average grain size of the conductive powder is preferably not more than 0.5 μm, more preferably from 0.05 μm to 0.45 μm, and further preferably from 0.05 μm to 0.35 μm. When the volume average grain size of the conductive powder falls within the foregoing range, dropping of the conductive powder from the coating layer is suppressed, and stable chargeability is obtainable.

A measurement method of the volume average grain size of the conductive powder follows the foregoing measurement method of the volume average grain size of the core.

A volume electric resistance of the conductive powder is preferably from $10^1$ Ω·cm to $10^{11}$ Ω·cm, and more preferably from $10^3$ Ω·cm to $10^9$ Ω·cm. In this specification, the volume electric resistance of the conductive powder means a value as measured in the following method.

The conductive powder is filled in a thickness of about 1 mm in a container having a sectional area of $2\times10^{-4}$ $m^2$ at ordinary temperature and ordinary humidity, and thereafter, a load of $1\times10^4$ $kg/m^2$ is applied onto the filled conductive powder by a metal-made member. A voltage at which an electric field of $10^6$ V/m is generated is impressed between the metal-made member and a bottom electrode of the container, and a value computed from a current value on that occasion is defined as a volume electric resistance value.

A content of the conductive powder in the coating resin layer is preferably from 1% by volume to 80% by volume, more preferably from 2% by volume to 20% by volume, and further preferably from 3% by volume to 10% by volume.

Examples of a method for forming the coating layer on the surface of the core of the carrier include an immersion method of preparing a coating layer-forming solution containing the resin, the conductive powder and a solvent and immersing the core particle therein; a spraying method of spraying a coating layer-forming solution onto the surface of the core particle; a fluidized bed method of spraying a coating layer-forming solution in a state where the core particle is floated with fluidizing air; and a kneader coater method of mixing the core particle and a coating layer-forming solution in a kneader coater and removing the solvent.

The solvent which is used for preparing the coating layer-forming solution is not particularly limited so far as it is able to dissolve the resin therein. For example, aromatic hydrocarbons such as toluene and xylene; ketones such as acetone and methyl ethyl ketone; and ethers such as tetrahydrofuran and dioxane may be used.

In order to make the coating layer have the foregoing coverage, it is preferable to use a fluidized bed apparatus for dispersing and fluidizing the core particle in an air stream and spraying the coating layer to achieve coating.

(3) Physical Properties of Carrier:

A saturation magnetization of the carrier is preferably 40 emu/g or more, and more preferably 50 emu/g or more.

A vibrating sample magnetometer VSMP10-15 (manufactured by Toei Industry Co., Ltd.) is used as a device for the measurement of a magnetic characteristic. A measurement sample is filled in a cell having an internal diameter of 7 mm and a height of 5 mm, and the cell is then set in the foregoing device. The measurement is performed by applying an impression magnetic field and sweeping it to 1,000 oersteds at maximum. Subsequently, the impression magnetic field is reduced to prepare a hysteresis curve on recording paper. A saturation magnetization, a residual magnetization and a coercive force are determined from data of the curve. In the present exemplary embodiment, the saturation magnetization refers to a magnetization measured in a magnetic field of 1,000 oersteds.

Also, a volume electric resistance of the carrier is preferably controlled in the range of from $1\times10^{7}$ Ω·cm to $1\times10^{15}$ Ω·cm, more preferably controlled in the range of from $1\times10^{8}$ Ω·cm to $1\times10^{14}$ Ω·cm, and further preferably controlled in the range of from in the range of from $1\times10^{8}$ Ω·cm to $1\times10^{13}$ Ω·cm. When the volume electric resistance of the carrier falls within the foregoing range, the resistance value is adequate; the carrier sufficiently acts as a developing electrode at the time of development; solid reproducibility is excellent; and the matter that when the toner concentration in the developer is lowered, injection of a charge from a developing roller into the carrier is suppressed, whereby the carrier itself is developed is suppressed.

The volume electric resistance (Ω·cm) of the carrier is measured in the following manner. As the measurement environment, the temperature is 20° C., and the humidity is 50% RH.

A carrier which is a subject of the measurement is evenly placed in a thickness of from about 1 mm to 3 mm on the surface of a circular jig in which an electrode plate of 20 $cm^2$ is disposed, thereby forming a carrier layer. The same electrode plate of 20 $cm^2$ is placed thereon, and the carrier layer is interposed therebetween. In order to remove voids between the carriers, a load of 4 kg is applied on the electrode plate placed on the carrier layer, and a thickness (cm) of the carrier layer is measured. An electrometer and a high-pressure power generating device are connected to the both electrodes on the top and bottom of the carrier layer. A high voltage is impressed between the both electrodes such that an electric field is $10^{3.8}$ V/cm, and a current value (A) flowing at that time is read, thereby computing a volume electric resistance (Ω·cm) of the carrier. A computation expression of the volume electric resistance (Ω·cm) of the carrier is as follows.

$$R=E\times20/(I-I_0)/L$$

In the foregoing expression, R represents a volume electric resistance (Ω·cm) of the carrier; E represents an impression voltage (V); I represents a current value (A); $I_0$ represents a current value (A) at an impression voltage of 0 V; and L represents a thickness (cm) of the carrier layer. Also, the coefficient "20" represents an area ($cm^2$) of the electrode plate.

<Process Cartridge>

The process cartridge according to the present exemplary embodiment is one which is detachable to the image forming apparatus and which includes an image holding member rotating in one direction; a development unit of feeding a toner to an electrostatic latent image formed on the surface of the image holding member to form a toner image; and a feed unit of feeding at least one photoreactive component.

In the case where the toner includes all of the photoreactive components therein, a process cartridge which is not provided with a feed unit of feeding a photoreactive component is used in the present exemplary embodiment.

The toner cartridge according to the present exemplary embodiment may accommodate the electrostatic-image-developing toner as an electrostatic image developer therein.

Also, the process cartridge according to the present exemplary embodiment is a process cartridge including a developer holding member and at least accommodating an electrostatic-image-developing toner or an electrostatic image developer therein.

The toner cartridge according to the present exemplary embodiment is detachable to the image forming apparatus. That is, in the image forming apparatus having a configuration such that the toner cartridge is detachable relative thereto, the toner cartridge according to the present exemplary embodiment which accommodates a toner composed of a baroplastic as a binder resin therein is suitably useful.

Also, the toner cartridge may be a cartridge accommodating a toner and a carrier therein, or a cartridge accommodating a toner singly therein and a cartridge accommodating a carrier singly therein may be separately provided.

The process cartridge according to the present exemplary embodiment is properly detached from the image forming apparatus.

Also, in addition to the foregoing, the process cartridge may include other members such as a destaticization unit, if desired.

As the process cartridge, known configurations may be adopted, and for example, JP-A-2008-209489, JP-A-2008-233736 and so on may be made hereof by reference.

<Image Forming Apparatus>

An example of the image forming apparatus according to the present exemplary embodiment is described.

FIG. 1 is a diagrammatic configuration view of the image forming apparatus according to the present exemplary embodiment. A numeral 4 represents an image holding member (photoconductor), and this image holding member 4 is a representative example of an electrostatic latent image forming material in the present exemplary embodiment. The image holding member 4 is one prepared by forming an organic photoconductor (OPC) as a photoconductor layer on the periphery of an aluminum-made drum substrate and rotates at a prescribed rate in an arrow direction. In the present exemplary embodiment, the image holding member 4 has an outer diameter of 60 mm.

In FIG. 1, exposure light is emitted from a semiconductor laser light source 1 on the basis of information read by an original reader. This is distributed to the vertical direction against the paper surface by a polygon mirror 2 and irradiated on the surface of a photoconductor via an fθ lens 3 capable of correcting a strain of an image, thereby forming an electrostatic latent image. The photoconductor is uniformly and homogeneously charged in advance without causing unevenness by a charge unit 5 and starts its rotation while fixing the timing.

An electrostatic latent image on the image holding member 4 is developed by a development unit 6, and a formed developed image is transferred onto a transfer-receiving material 8 having been conveyed while fixing the timing by the action of a transfer unit 7. Furthermore, though the image holding member 4 and the transfer-receiving material 8 are separated from each other by a separation unit (separation electrode) 9, the toner image is transferred to and held by the transfer-receiving material 8, introduced into a fixing unit 10 and fixed therein.

The fixing unit 10 is configured to include a pair of pressure rollers 10*a* of pressure fixing the toner; a unit 10*b* of feeding the photoreactive component; and an irradiation unit 10*c* of irradiating ultraviolet rays.

An untransferred toner which remains on the surface of the image holding member 4, or the like is cleaned up by a cleaning unit 11 of a cleaning blade mode; a residual charge is removed by exposure before charge; and for the subsequent image formation, homogeneous charge is again carried out by the charge unit 5.

A cleaning blade 13 is composed of a rubbery elastic material having a thickness of from about 1 mm to 30 mm, and a urethane rubber is most frequently used.

The transfer-receiving material may also be called a recording material, recording paper, an image support or the like, and plain paper is representative for such a material. The transfer-receiving material is not particularly limited so far as it is able to transfer an unfixed image after the development, and as a matter of course, a PET base for OHP or the like is included.

Also, the image forming apparatus can be made an embodiment mounted with a process cartridge including the image holding member 4 and at least one of the charge unit 5, the development unit 6, the cleaning unit 11 and the transfer unit 7.

The image forming method according to the present exemplary embodiment is a method in which the toner image having been transferred onto the transfer-receiving material such as paper is temporarily fixed upon being allowed to pass through a pressure-imparting device constituted of a pair of upper and lower rollers and capable of imparting a pressure of from 1 MPa to 5 MPa; thereafter, a necessary photoreactive component is fed to the toner image, if desired; and ultraviolet rays are then irradiated to cure a ultraviolet ray-curable component, thereby fixing an image on the paper.

In the present exemplary embodiment, it is preferable that a photopolymerization initiator is fed to the toner image.

In that case, the pressure-imparting device constituted of upper and lower rollers is one in which a pressure is applied to a pair of metal-made rollers by a spring, etc.

As the pressure to be applied, a pressure for revealing baroplastic properties may be impressed. Specifically, the pressure is from 1 MPa to 5 MPa. When the pressure to be applied falls within the foregoing range, a sufficient baroplastic behavior is revealed; whereas smoothness of paper is increased due to an excessive pressure, no gloss is generated, and there is no possibility of expansion of the image to be caused due to elongation of the paper.

<Ultraviolet Ray-Irradiating Step and Ultraviolet Ray-Irradiating Measure>

The "radiations" as referred to in the present exemplary embodiment are not particularly limited so far as they are active radiations having energy capable of generating an initiation species of a curing reaction upon being irradiated within a toner particle or in the vicinity thereof and widely include α-rays, γ-rays, X-rays, ultraviolet rays (UV), visible light beams and electron beams. Of these, from the viewpoints of curing sensitivity and easiness of availability of an apparatus, ultraviolet rays and electron beams are preferable, and ultraviolet rays are especially preferable.

Examples of a light source for irradiating ultraviolet rays include a xenon lamp, an ultraviolet curing type lamp (for example, a metal halide lamp) and a UV-LED ultraviolet light source. Of these, a UV-LED ultraviolet light source is preferably useful.

An exposure intensity of the exposure in the irradiation step is preferably from 30 mW/cm$^2$ to 200 mW/cm$^2$ (in a UVA region), more preferably from 40 mW/cm$^2$ to 150 mW/cm$^2$ (in a UVA region), and especially preferably from 50 mW/cm$^2$ to 120 mW/cm$^2$ (in a UVA region) on a transfer-receiving medium. Also, an exposure intensity in a UVB region is preferably not more than 100 mW/cm$^2$, more preferably not more than 50 mW/cm$^2$, and further preferably not more than 20 mW/cm$^2$ on a transfer-receiving medium.

The values of exposure intensity as shown herein are those measured using a UV analyzer (UV POWER MAP, manufactured by EIT Corporation). Here, UVA means a wavelength region of from 320 nm to 390 nm; UVB means a wavelength region of from 280 nm to 320 nm; and UVC means a wavelength region of from 250 to 260 nm.

EXAMPLES

The present exemplary embodiment is hereunder described in more detail with reference to the following Examples, but it should be construed that the present exemplary embodiment is not limited thereto at all.

In the following description, the term "parts" means "parts by weight", unless otherwise indicated.

[Preparation of Resin for Toner and Preparation of Resin Dispersion]

(Preparation of Resin Particle Dispersion (A1) (Styrene-Butyl Acrylate Base))

In a round type glass flask, 60 g of butyl acrylate and 2 g of a radical initiator (KPS) are added, and the mixture is subjected to a polymerization reaction at 120° C. Thereafter, 43 g of a styrene monomer is added, and a molecular weight is confirmed by means of GPC. Subsequently, 5 g of 1,4-divinylbenzene is added to synthesize a vinyl based block polymer of styrene-butyl acrylate containing a reactive site in a styrene segment thereof. An {(Mn of the styrene segment)/(Mn of the butyl acrylate segment)} ratio of this copolymers is found to be 0.9 by GPC analysis.

To 100 parts by weight of this resin, 0.5 parts by weight of soft type sodium dodecylbenzenesulfonate as a surfactant is added; 300 parts by weight of ion exchanged water is further added; and the mixture is thoroughly mixed and dispersed by a homogenizer (ULTRA TURRAX T50, manufactured by IKA) in a round type glass-made flask while heating at 80° C. A dispersion having a median size of the resin particle of 190 nm is obtained. There is thus obtained a resin particle dispersion (A1) having a solids content adjusted at 25%.

(Preparation of Resin Particle Dispersion (A2) (BPA-TPA Base))

Terephthalic acid and BPA-2EO (an ethylene oxide adduct of bisphenol A) are subjected to dehydration condensation at 200° C. using tin oxide as a catalyst, to which are subsequently added trimellitic acid and hydroxyethyl acrylate, thereby synthesizing Resin A.

Separately, succinic acid and 1,3-propanediol are subjected to hydration condensation at 120° C. in the presence of an acid catalyst, thereby synthesizing Resin B.

The foregoing Resin A and Resin B are subjected to block copolymerization in the presence of dodecylbenzenesulfonic acid (acid catalyst), thereby synthesizing a desired polyester block copolymer having a photoreactive site.

An {(Mn of the terephthalic acid-containing segment)/(Mn of the succinic acid-containing segment)} ratio of this copolymer is found to be 0.8 by GPC analysis.

To 100 parts by weight of this resin, 0.5 parts by weight of soft type sodium dodecylbenzenesulfonate as a surfactant is added; 300 parts by weight of ion exchanged water is further added; and the mixture is thoroughly mixed and dispersed by a homogenizer (ULTRA TURRAX T50, manufactured by IKA) in a round type glass-made flask while heating at 80° C. There is thus obtained a resin particle dispersion (A2) having a median size of the resin particle of 210 nm and having a solids content adjusted at 25%.

A comparative resin particle dispersion is prepared in the following manner.

(Preparation of Resin Particle Dispersion (A3) (St-BA))

2 g of a radical initiator (KPS) is added to 60 g of butyl acrylate, and the mixture is subjected to a polymerization reaction at 120° C. Thereafter, 60 g of a styrene monomer is added to synthesize a vinyl based block polymer of styrene-butyl acrylate. An {(Mn of the styrene segment)/(Mn of the butyl acrylate segment)} ratio of this block copolymer is found to be 6.5 by GPC analysis.

To 100 parts by weight of this resin, 0.5 parts by weight of soft type sodium dodecylbenzenesulfonate as a surfactant is added; 300 parts by weight of ion exchanged water is further added; and the mixture is thoroughly mixed and dispersed by a homogenizer (ULTRA TURRAX T50, manufactured by IKA) in a round type glass-made flask while heating at 80° C.

There is thus obtained a resin particle dispersion (A3) having a median size of the resin particle of 180 nm and having a solids content adjusted at 25%.

Another comparative resin particle dispersion is prepared in the following manner.

(Preparation of Resin Particle Dispersion (A4) (BPA-TPA))

100 g of terephthalic acid and 209 g of BPA-2EO (an ethylene oxide adduct of bisphenol A) are subjected to dehydration condensation at 200° C. in the presence of dibutyltin oxide (0.62 g) as a catalyst, thereby synthesizing Resin C.

The foregoing Resin C and Resin B are bound in the presence of an acid catalyst to form a block copolymer. There is thus synthesized a polyester block polymer. An {(Mn of the terephthalic acid-containing segment)/(Mn of the succinic acid-containing segment)} ratio of this copolymer is found to be 2.7 by GPC analysis.

To 100 parts by weight of this resin, 0.5 parts by weight of soft type sodium dodecylbenzenesulfonate as a surfactant is added; 300 parts by weight of ion exchanged water is further added; and the mixture is thoroughly mixed and dispersed by a homogenizer (ULTRA TURRAX T50, manufactured by IKA) in a round type glass-made flask while heating at 80° C.

There is thus obtained a resin particle dispersion (A4) having a median size of the resin particle of 165 nm and having a solids content adjusted at 25%.

(Preparation of Coloring Agent Particle Dispersion (P1))

| | |
|---|---|
| Cyan pigment (copper phthalocyanine, C.I. Pigment Blue 15:3, manufactured by Dainichiseika Color & Chemicals Mfg. Co., Ltd.): | 50 parts by weight |
| Anionic surfactant (NEOGEN RK, manufactured by Dai-ichi Kogyo Seiyaku Co., Ltd.): | 5 parts by weight |
| Ion exchanged water: | 200 parts by weight |

The foregoing components are mixed and dissolved, and the solution is dispersed by a homogenizer (ULTRA TURRAX T50, manufactured by IKA) for 5 minutes and a ultrasonic bath for 10 minutes, respectively, thereby obtaining a cyan coloring agent particle dispersion (P1) having a median size of 190 nm and a solids content of 21.5%.

(Preparation of Release Agent Particle Dispersion (W1))

30 parts by weight of dodecyl sulfuric acid and 852 parts by weight of ion exchanged water are mixed to prepare a dodecyl sulfuric acid aqueous solution.

188 parts by weight of palmitic acid and 25 parts by weight of pentaerythritol are mixed; the mixture is melted by heating at 250° C.; the melt is thrown into the foregoing dodecyl sulfuric acid aqueous solution; the mixture is emulsified in a homogenizer (ULTRA TURRAX T50, manufactured by IKA) for 5 minutes and further emulsified in a ultrasonic bath for 15 minutes; and the emulsion is kept at 70° C. in a flask while stirring and held for 15 hours.

There is thus obtained a release agent particle dispersion (W1) having a median size of the particle of 200 nm, a melting temperature of 72° C. and a solids content of 20%.

Toner Example 1

Preparation of Toner Particle T1

| | |
|---|---|
| Resin particle dispersion (A1): | 168 parts by weight (resin: 42 parts by weight) |
| Coloring agent particle dispersion (P1): | 40 parts by weight (pigment: 8.6 parts by weight) |
| Release agent particle dispersion (W1): | 40 parts by weight (release agent: 8.0 parts by weight) |
| Aluminum polychloride: | 0.15 parts by weight |
| Ion exchanged water: | 300 parts by weight |

The foregoing components are thoroughly mixed and dispersed by a homogenizer (ULTRA TURRAX T50, manufactured by IKA) in a round type stainless steel-made flask according to the foregoing blend; the dispersion is heated to 42° C. by an oil bath for heating while stirring the flask; after keeping at 42° C. for 60 minutes, 84 parts by weight (resin: 21 parts by weight) of the resin particle dispersion (A1) is additionally added; and the mixture is gently stirred.

Thereafter, the system is adjusted at a pH of 6.0 with 0.5 moles/liter of a sodium hydroxide aqueous solution and then heated to 95° C. while continuing stirring. During an interval until the temperature reaches 95° C., a sodium hydroxide aqueous solution is additionally dropped such that the pH does not decrease to 5.0 or less. The system is kept at 95° C. for 3 hours.

After completion of the reaction, the reaction mixture is cooled, filtered and then thoroughly washed with ion exchanged water, followed by solid-liquid separation by means of Nutsche suction filtration. The resultant is then redispersed in 3 liters of ion exchanged water at 40° C. and stirred and washed at 300 rpm for 15 minutes. This washing operation is repeated 5 times, subjected to solid-liquid separation by means of Nutsche suction filtration and subsequently dried in vacuo for 12 hours, thereby obtaining Toner Particle T1.

A grain size of the thus obtained toner particle is measured by Coulter Multimizer Type II (manufactured by Beckman Coulter K.K.). As a result, the toner particle is found to have an accumulated volume average grain size $D_{50}$ of 5.05 μm and a volume average grain size distribution index $GSD_v$ of 1.20.

Also, the toner particle has a potato-like shape having a shape factor SF1, as determined by shape observation by a Luzex image analyzer, of 129.

1.5 parts by weight of hydrophobic silica (TS720, manufactured by Cabot Corporation) is added to 50 parts by weight of the foregoing toner particle, and these components are mixed in a sample mill to obtain an external additive toner.

Toner Example 2

Preparation of Toner Particle T2

Toner Particle T2 is prepared in the same manner as in Toner Example 1, except for using the resin particle dispersion (A2), the release agent particle dispersion (W1) and the coloring agent particle dispersion (P1), replacing the aluminum polychloride by aluminum sulfate and changing the pH to 7.0 during the elevation of temperature to 95° C., and then evaluated.

Toner Comparative Example 1

Preparation of Toner Particle T3

| | |
|---|---|
| Resin particle dispersion (A3): | 168 parts by weight (resin: 42 parts by weight) |
| Coloring agent particle dispersion (P1): | 40 parts by weight (pigment: 8.6 parts by weight) |
| Release agent particle dispersion (W1): | 40 parts by weight (release agent: 8.0 parts by weight) |
| Aluminum polychloride: | 0.15 parts by weight |
| Ion exchanged water: | 300 parts by weight |

The foregoing components are thoroughly mixed and dispersed by a homogenizer (ULTRA TURRAX T50, manufactured by IKA) in a round type stainless steel-made flask according to the foregoing blend; the dispersion is heated to 42° C. by an oil bath for heating while stirring the flask; after keeping at 42° C. for 60 minutes, 84 parts by weight (resin: 21 parts by weight) of the resin particle dispersion (A3) is additionally added; and the mixture is gently stirred.

Thereafter, the system is adjusted at a pH of 6.0 with 0.5 moles/liter of a sodium hydroxide aqueous solution and then heated to 95° C. while continuing stirring. During an interval until the temperature reaches 95° C., a sodium hydroxide aqueous solution is additionally dropped such that the pH does not decrease to 5.0 or less. The system is kept at 95° C. for 3 hours.

After completion of the reaction, the reaction mixture is cooled, filtered and then thoroughly washed with ion exchanged water, followed by solid-liquid separation by means of Nutsche suction filtration. The resultant is then redispersed in 3 liters of ion exchanged water at 40° C. and stirred and washed at 300 rpm for 15 minutes. This washing operation is repeated 5 times, subjected to solid-liquid separation by means of Nutsche suction filtration and subsequently dried in vacuo for 12 hours, thereby obtaining Comparative Toner Particle T3.

Toner Comparative Example 2

Preparation of Toner Particle T4

| | |
|---|---|
| Resin particle dispersion (A4): | 168 parts by weight (resin: 42 parts by weight) |
| Coloring agent particle dispersion (P1): | 40 parts by weight (pigment: 8.6 parts by weight) |
| Release agent particle dispersion (W1): | 40 parts by weight (release agent: 8.0 parts by weight) |
| Aluminum polychloride: | 0.15 parts by weight |
| Ion exchanged water: | 300 parts by weight |

The foregoing components are thoroughly mixed and dispersed by a homogenizer (ULTRA TURRAX T50, manufactured by IKA) in a round type stainless steel-made flask according to the foregoing blend; the dispersion is heated to 42° C. by an oil bath for heating while stirring the flask; after keeping at 42° C. for 60 minutes, 84 parts by weight (resin: 21 parts by weight) of the resin particle dispersion (A4) is additionally added; and the mixture is gently stirred.

Thereafter, the system is adjusted at a pH of 6.0 with 0.5 moles/liter of a sodium hydroxide aqueous solution and then heated to 95° C. while continuing stirring. During an interval until the temperature reaches 95° C., a sodium hydroxide aqueous solution is additionally dropped such that the pH does not decrease to 5.0 or less. The system is kept at 95° C. for 3 hours.

After completion of the reaction, the reaction mixture is cooled, filtered and then thoroughly washed with ion exchanged water, followed by solid-liquid separation by means of Nutsche suction filtration. The resultant is then redispersed in 3 liters of ion exchanged water at 40° C. and stirred and washed at 300 rpm for 15 minutes. This washing operation is repeated 5 times, subjected to solid-liquid separation by means of Nutsche suction filtration and subsequently dried in vacuo for 12 hours, thereby obtaining Comparative Toner Particle T4.

<Measurement of Melt Viscosity of Toner>

A flow tester (Model CFT-500A, manufactured by Shimadzu Corporation) is used; a temperature is raised from 25° C. at a rate of 1° C./min at the time of impressing each of loads of 10 MPa and 1 MPa; and a temperature at which a viscosity reaches $10^4$ Pa·s under a pressure of 5 MPa and 1 MPa, respectively is measured.

The measurement results of the melt viscosities of the respective toners prepared in Toner Examples 1 and 2 and Toner Comparative Examples 1 and 2 are summarized and shown in Table 1. $D_{50}$ represents an accumulated volume average grain size; $GSD_v$ represents a volume average grain size distribution index; and SF1 represents a shape factor of the toner particle.

TABLE 1

| Toner | $D_{50}$ (μm) | $GSD_v$ | SF1 |
|---|---|---|---|
| T1 | 5.05 | 1.20 | 129 |
| T2 | 5.24 | 1.19 | 127 |
| T3 | 5.39 | 1.21 | 131 |
| T4 | 5.09 | 1.21 | 129 |

1.5 parts by weight of hydrophobic silica (TS720, manufactured by Cabot Corporation) is added to 50 parts by weight of the foregoing toner particle, and these components are mixed in a sample mill to obtain an external additive toner.

<Preparation of Carrier>

(Preparation of Core Particle C1)

| | |
|---|---|
| Phenol: | 40 parts by weight |
| Formalin: | 60 parts by weight |
| Magnetite: | 400 parts by weight (average grain size: 0.20 μm, spherical, treated with 1% by weight KBM403) |
| Ammonia water: | 12 parts by weight |
| Ion exchanged water: | 60 parts by weight |

The foregoing mixture is subjected to gradual temperature rising to 85° C. while stirring and allowed to react and cure for 4 hours; and the reaction mixture is then cooled, filtered, washed and dried to obtain a core particle C1 having a grain size of 37.3 μm.

(Preparation of Carrier)

| | |
|---|---|
| Core particle C1: | 100 parts by weight |

<Coating Layer Forming Solution 1>

| | |
|---|---|
| Toluene: | 120 parts by weight |
| Styrene-methyl methacrylate (St-MMA) copolymer (weight ratio: 60/40, weight average molecular weight: 80,000): | 3.5 parts by weight |
| Carbon black (REGAL 1330, manufactured by Cabot Corporation): | 0.4 parts by weight |

The foregoing components exclusive of the core particle C1 are stirred and dispersed by a stirrer for 60 minutes, thereby preparing a coating layer forming solution 1.

Subsequently, this coating layer forming solution 1 and the core particle C1 are charged in a fluidized bed (a trade name: MP-01SFP, manufactured by Powrex Corporation) and subjected to coating at a rotation number of blade of 1,000 rpm, an air flow of 1.2 $m^3$/min and a solution discharge rate of 10 g/min and at 70° C., and the resultant is allowed to pass through a mesh with an opening of 75 μm, thereby preparing Carrier 1.

A coverage of the coating resin of the carrier is found to be 96%.

<Preparation of Developer>

A toner and a carrier are weighed in a weight ratio of 8/92, and the both are stirred and mixed in a ball mill for 20 minutes to prepare each developer. There are thus prepared developers of Examples 1 and 2 and developers of Comparative Examples 1 and 2.

TABLE 2

| Example No. | Toner | Carrier |
|---|---|---|
| Example 1 | T1 | Carrier 1 |
| Example 2 | T2 | Carrier 1 |
| Comparative Example 1 | T3 | Carrier 1 |
| Comparative Example 2 | T4 | Carrier 1 |

<Evaluation of Image Quality of Fixed Image>

An image quality of a fixed image of the toner is evaluated in the following manner. Each of the foregoing developers is used; in a remodeled machine of Docu Centre Color f450, manufactured by Fuji Xerox Co., Ltd., a two-roller type fixing machine is modified such that a maximum fixing pressure is 5 MPa (50 kgf/$cm^2$); a coated paper, manufactured by Fuji Xerox Co., Ltd. is used as a transfer paper; printing is carried out in an atmosphere at 22° C. and 55% RH while regulating a fixing roller temperature at room temperature; and a process speed is regulated at 60 mm/sec such that the temperature of the fixing rollers does not exceed 30° C.

(Feed Step)

After pressure fixing, an aqueous dispersion of IRGACURE 819 (IRGACURE 819DW, effective component: 45%) is diluted eight-fold with water, and the solution is subjected to roller coating.

The coating is performed in a coating amount of 0.04 mg/$cm^2$.

(Irradiation Step)

A temporarily fixed toner image is irradiated with ultraviolet rays by using a UV-LED lamp. An irradiation amount is 50 mW/$cm^2$.

<Evaluation Method>

(Pencil Hardness Test)

A solid cyan image is printed on an A4-size paper with the thus prepared cyan developer and then subjected to a pencil hardness test.

In the pencil hardness test evaluation, the image is scratched by a pencil with a hardness of from 4H to 6B, and whether or not the image is shaven is determined. Specific evaluation criteria are as follows.

A: The image area is not shaven by a pencil with a hardness of 4H.

B: The image area is not shaven by a pencil with a hardness of from 3H to 6B.

C: The image area is shaven by a pencil with a hardness of 6B, or the image is not fixed.

In the following Table 3, $T_B$ (30) represents a temperature (° C.) at which a viscosity of the toner reaches $10^4$ Pa·s at the time of impressing a load of 30 MPa by the flow tester method before the irradiation step; and $T_A$ (30) represents a temperature at which a viscosity of the toner reaches $10^4$ Pa·s at the time of impressing a load of 30 MPa by the flow tester method after the irradiation step of the toner.

TABLE 3

| | | Example 1 | Example 2 | Comparative Example 1 | Comparative Example 2 |
|---|---|---|---|---|---|
| Operation condition | Fixing pressure | 5 MPa | 5 MPa | 10 MPa | 10 MPa |
| | Photopolymerization initiator | IRGACURE 819DW | IRGACURE 819DW | — | — |
| | Feed method of photopolymerization initiator | Roller coating after fixing | Roller coating after fixing | — | — |
| | Reactive group (ethylenically unsaturated group) | Bonded to binder resin (styryl group) | Bonded to binder resin (acryloyl group) | No | No |
| | Additive | Arbitrary | Arbitrary | | |
| | Irradiation time of UV-LED | One second | One second | One second | One second |
| Binder resin | Binder resin dispersion | A1 | A2 | A3 | A4 |
| | High-Tg component monomer unit | Styrene | Succinic acid-1,3-propanediol | Styrene | Succinic acid-1,3-propanediol |
| | Low-Tg component | Butyl acrylate | Terephthalic acid-BPA-2EO | Butyl acrylate | Terephthalic acid-BPA-2EO |
| Temperature at which the viscosity reaches $10^4$ Pa · s | $T_B$ (30) | 38° C. | 36° C. | — | — |
| | $T_A$ (30) | 110° C. | 88° C. | — | — |

TABLE 3-continued

| | | Example 1 | Example 2 | Comparative Example 1 | Comparative Example 2 |
|---|---|---|---|---|---|
| Number average molecular weight ratio | (Before UV irradiation)/(After UV irradiation) | 0.9 → 1.6 | 0.8 → 1.55 | 2 → 2 | 2 → 2 |
| Image quality evaluation | Pencil hardness | A | A | B | B |

What is claimed is:

1. An image forming method comprising:

charging an image holding member;

forming an electrostatic latent image on a surface of the image holding member;

developing the electrostatic latent image formed on the surface of the image holding member with a toner or an electrostatic image developer to form a toner image;

transferring the toner image formed on the surface of the image holding member onto a surface of a transfer-receiving material;

fixing the toner image by pressurization without heating;

feeding at least one photoreactive component to the toner or toner image; and irradiating the toner image with ultraviolet rays, wherein the toner satisfies the relationship of the following relational expression (1):

$$T_B(30) \leqq 100 < T_A(30) \quad (1)$$

wherein $T_B$ (30) represents a temperature (° C.) at which a viscosity of the toner reaches $10^4$ Pa·s at the time of impressing a load of 30 MPa before the irradiating of the toner image; and $T_A$ (30) represents a temperature at which a viscosity of the toner reaches $10^4$ Pa·s at the time of impressing a load of 30 MPa after the irradiating of the toner image.

2. The image forming method according to claim 1, wherein a binder resin of the toner is formed of a high-Tg component and a low-Tg component;

$(Mn(HTg)/Mn(LTg))_B$, which is a ratio of a number average molecular weight of the high-Tg component to a number average molecular weight of the low-Tg component in the binder resin before the irradiating of the toner image, is not more than about 1.5; and $(Mn(HTg)/Mn(LTg))_A$, which is a ratio of a number average molecular weight of the high-Tg component to a number average molecular weight of the low-Tg component in the binder resin after the irradiating of the toner image, is more than about 1.5.

3. The image forming method according to claim 1, wherein a binder resin of the toner is a resin which satisfies a relationship of the following expression (3):

$$\Delta T_p = T_{p1} - T_{p5} \geqq 20° \text{ C.} \quad (3)$$

wherein $T_{p1}$ represents a temperature at which a melt viscosity of the resin as measured at a load of 1 MPa (10 kgf/cm$^2$) reaches 10,000 Pa·s; and $T_{p5}$ represents a temperature at which a melt viscosity of the resin as measured at a load of 5 MPa (50 kgf/cm$^2$) reaches 10,000 Pa·s.

4. The image forming method according to claim 1, wherein the photoreactive component is a component capable of undergoing a curing reaction upon being irradiated with active radiations.

5. The image forming method according to claim 4, wherein the component capable of undergoing a curing reaction upon being irradiated with active radiations comprises a component capable of undergoing photodimerization and a component capable of undergoing photopolymerization.

6. The image forming method according to claim 5, wherein the component capable of undergoing photodimerization is a cinnamic acid ester.

7. The image forming method according to claim 5, wherein the component capable of undergoing photopolymerization has an addition polymerizable component.

8. The image forming method according to claim 7, wherein the addition polymerizable component is an ethylenically unsaturated compound.

9. The image forming method according to claim 8, wherein the ethylenically unsaturated compound includes any one of a compound having a (meth)acryloyloxy group, a compound having a (meth)acrylamide group and a compound having a vinyl group.

10. The image forming method according to claim 1, wherein the toner contains a photopolymerization initiator.

11. The image forming method according to claim 10, wherein a content of the photopolymerization initiator is from about 0.01% by weight to about 35% by weight relative to a total amount of an ethylenically unsaturated compound.

12. The image forming method according to claim 1, wherein a fixing pressure of the fixing of the toner image is from about 1 MPa to about 5 MPa.

13. An image forming apparatus comprising:

an image holding member;

a charge unit that charges the image holding member;

an exposure unit that exposes the charged image holding member to form an electrostatic latent image on a surface of the image holding member;

a development unit that develops the electrostatic latent image with a toner or an electrostatic image developer to form a toner image;

a transfer unit that transfers the toner image onto a surface of a transfer-receiving material from the image holding member;

a fixing unit that pressurizes the transferred toner image on the surface of the transfer-receiving material;

a feed unit that feeding at least one photoreactive component to the toner or toner image; and an irradiation unit that irradiates the fixed toner image with ultraviolet rays, wherein the toner satisfies a relationship of the following relational expression (1):

$$T_B(30) \leqq 100 < T_A(30) \quad (1)$$

wherein $T_B$ (30) represents a temperature (° C.) at which a viscosity of the toner reaches $10^4$ Pa·s at the time of impressing a load of 30 MPa before the irradiation; and $T_A$ (30) represents a temperature at which a viscosity of the toner reaches $10^4$ Pa·s at the time of impressing a load of 30 MPa after the irradiation.

14. A process cartridge which is detachable to the image forming apparatus of claim 13, comprising:

an image holding member that rotates in one direction;

a development unit that feeds a toner to an electrostatic latent image formed on a surface of the image holding member to form a toner image; and a feed unit that feeds at least one photoreactive component.

15. The image forming apparatus according to claim 13, wherein a fixing pressure of the fixing unit is from about 1 MPa to about 5 MPa.

16. The image forming apparatus according to claim 13, wherein the toner image contains a photopolymerization initiator.

17. The image forming apparatus according to claim 16, wherein a content of the photopolymerization initiator is from about 0.01% by weight to about 35% by weight relative to a total amount of an ethylenically unsaturated compound contained in the photoreactive component.

18. The image forming apparatus according to claim 13, wherein the irradiation unit is a UV-LED ultraviolet light source.

* * * * *